US007621343B2

(12) United States Patent
Chen et al.

(10) Patent No.: US 7,621,343 B2
(45) **Date of Patent: *Nov. 24, 2009**

(54) STEERABLE DRILLING SYSTEM AND METHOD

(75) Inventors: Chen-Kang D. Chen, Houston, TX (US); Thomas M. Gaynor, Aberdeen (GB); Daniel D. Gleitman, Houston, TX (US); John R. Hardin, Jr., Houston, TX (US); Colin Walker, Conchez-de-Bearn (FR); M. Vikram Rao, Houston, TX (US); Roger Boulton, Mossel Bay (ZA)

(73) Assignee: Halliburton Energy Services, Inc., Houston, TX (US)

( * ) Notice: Subject to any disclaimer, the term of this patent is extended or adjusted under 35 U.S.C. 154(b) by 25 days.

This patent is subject to a terminal disclaimer.

(21) Appl. No.: 11/491,738

(22) Filed: Jul. 24, 2006

(65) Prior Publication Data

US 2006/0266555 A1 Nov. 30, 2006

Related U.S. Application Data

(63) Continuation of application No. 10/230,709, filed on Aug. 29, 2002, now Pat. No. 7,147,066, which is a continuation of application No. 09/378,023, filed on Aug. 21, 1999, now Pat. No. 6,581,699, which is a continuation-in-part of application No. 09/217,764, filed on Dec. 21, 1998, now Pat. No. 6,269,892.

(51) Int. Cl.
*E21B 7/04* (2006.01)
*E02D 29/00* (2006.01)

(52) U.S. Cl. ..... 175/61; 175/62

(58) Field of Classification Search ..... 175/50, 175/61, 62, 73, 75, 45, 26, 40, 27
See application file for complete search history.

(56) References Cited

U.S. PATENT DOCUMENTS 3,398,804 A 8/1968 Holbert
3,765,494 A 10/1973 Kielman
4,307,786 A * 12/1981 Evans ..... 175/231
4,428,441 A * 1/1984 Dellinger ..... 175/61
4,512,420 A 4/1985 Hayatdavoudi et al.

(Continued)

FOREIGN PATENT DOCUMENTS

| | | |
|---|---|---|
| EP | 0171259 | 7/1985 |
| EP | 0287155 | 6/1988 |
| EP | 0497422 B1 | 1/1992 |
| EP | 0554977 B1 | 1/1993 |
| EP | 0594418 B1 | 10/1993 |

(Continued)

OTHER PUBLICATIONS

Dimiri et al., Article published in "Drilling Contractor" Jan./Feb. 1999, 2 pgs.

(Continued)

*Primary Examiner*—Thomas A Beach
(74) *Attorney, Agent, or Firm*—Browning Bushman, P.C.

(57) ABSTRACT

A bottom hole assembly 10 for drilling a deviated borehole includes a positive displacement motor (PDM) 12 or a rotary steerable device (RSD) 110 having a substantially uniform diameter motor housing outer surface without stabilizers extending radially therefrom. In a PDM application, the motor housing 14 may have a fixed bend therein between an upper power section 16 and a lower bearing section 18. The long gauge bit 20 powered by the motor 10 may have a bit face 22 with cutters 28 thereon and a gauge section 24 having a uniform diameter cylindrical surface 26. The gauge section 24 preferably has an axial length at least 75% of the bit diameter. The axial spacing between the bit face and the bend of the motor housing preferably is less than twelve times the bit diameter. According to the method of the present invention, the bit may be rotated at a speed of less than 350 rpm by the PDM and/or rotation of the RSD from the surface.

73 Claims, 8 Drawing Sheets

U.S. PATENT DOCUMENTS

| | | | | | |
|---|---|---|---|---|---|
| 4,653,598 | A | | 3/1987 | Schuh et al. | |
| 4,667,751 | A | | 5/1987 | Geczy et al. | |
| 4,817,740 | A | * | 4/1989 | Beimgraben | 175/74 |
| 4,828,053 | A | | 5/1989 | Maurer et al. | |
| 4,875,530 | A | | 10/1989 | Frink et al. | |
| 4,877,092 | A | * | 10/1989 | Helm et al. | 175/74 |
| 4,938,298 | A | * | 7/1990 | Rehm | 175/61 |
| 4,993,503 | A | | 2/1991 | Fischer et al. | |
| 5,042,597 | A | | 8/1991 | Rehm et al. | |
| 5,060,736 | A | | 10/1991 | Neff | |
| RE33,751 | E | | 11/1991 | Geczy et al. | |
| 5,090,496 | A | | 2/1992 | Walker | |
| 5,099,931 | A | * | 3/1992 | Krueger et al. | 175/75 |
| 5,213,168 | A | | 5/1993 | Warren et al. | |
| 5,311,953 | A | | 5/1994 | Walker | |
| 5,339,910 | A | | 8/1994 | Mueller | |
| 5,441,119 | A | | 8/1995 | Head | |
| 5,445,230 | A | * | 8/1995 | Wattenburg et al. | 175/74 |
| 5,448,227 | A | | 9/1995 | Orban et al. | |
| 5,465,799 | A | | 11/1995 | Ho | |
| 5,467,832 | A | | 11/1995 | Orban et al. | |
| 5,475,309 | A | | 12/1995 | Hong et al. | |
| 5,513,714 | A | | 5/1996 | Downie et al. | |
| 5,520,256 | A | | 5/1996 | Eddison | |
| 5,638,910 | A | | 6/1997 | Noe et al. | |
| 5,685,379 | A | | 11/1997 | Barr et al. | |
| 5,706,905 | A | | 1/1998 | Barr | |
| 5,803,185 | A | | 9/1998 | Barr et al. | |
| 5,806,611 | A | | 9/1998 | Van Den Steen et al. | |
| 5,813,480 | A | | 9/1998 | Zaleski et al. | |
| 5,853,053 | A | | 12/1998 | Gilchrist et al. | |
| 5,857,531 | A | | 1/1999 | Estep et al. | |
| 5,875,859 | A | | 3/1999 | Ikeda et al. | |
| 5,911,284 | A | | 6/1999 | von Gynz-Rekowski | |
| 5,967,247 | A | | 10/1999 | Pessier | |
| 6,021,377 | A | | 2/2000 | Dubinsky et al. | |
| 6,023,443 | A | | 2/2000 | Dubinsky et al. | |
| 6,047,784 | A | * | 4/2000 | Dorel | 175/61 |
| 6,088,294 | A | | 7/2000 | Leggett, III et al. | |
| 6,109,372 | A | * | 8/2000 | Dorel et al. | 175/61 |
| 6,202,731 | B1 | | 3/2001 | Rulon | |
| 6,244,361 | B1 | | 6/2001 | Comeau et al. | |
| 6,269,892 | B1 | | 8/2001 | Boulton et al. | |
| 6,581,699 | B1 | * | 6/2003 | Chen et al. | 175/61 |

FOREIGN PATENT DOCUMENTS

| | | | |
|---|---|---|---|
| EP | 0752046 | B1 | 3/1995 |
| EP | 0772724 | B1 | 7/1995 |
| GB | 2172324 | B | 3/1986 |
| GB | 2172325 | B | 3/1986 |
| GB | 2177738 | B | 3/1988 |
| GB | 2307537 | A | 11/1996 |
| JP | 1260195 | | 10/1989 |
| JP | 631764 | | 1/1996 |
| RU | 2060348 | C1 | 5/1996 |
| RU | 2062860 | | 6/1996 |
| SU | 205740 | | 2/1968 |
| SU | 1033685 | A | 10/1980 |
| SU | 1020562 | | 2/1982 |
| SU | 1049647 | | 2/1982 |
| SU | 1776281 | | 12/1990 |
| WO | WO 95/25872 | | 9/1995 |
| WO | WO 99/39074 | | 8/1999 |

OTHER PUBLICATIONS

Norris et al., Article published in "IADC/SPE" 1998, 14 pages.

Chen et al., Article published in "Oil & Gas Journal" Nov. 15, 1999, 7 pgs.

Stapel et al., IADC/SPE 35112, "Innovative Steerable System, Combined with Block Set Impregnated Diamond Bit Design, Dramatically Improves Economics of Ductch Horizontal Well" 1996 pp. 571-581.

Norris, et al. IADC/SPE 39308 Drilling Conference, Dallas, Texas, "Development and Successful Application of Unique Steerable PDC Bits" Mar. 3-6, 1998, pp. 155-166.

Offshore Europe, "Steerable Turbodrilling Setting New ROP Records" Aug. 1997, pp. 40, 42.

DeLucia, Oil and Gas Journal, "System Analysis Improves Downhole Motor Performance" May 17, 1998, pp. 50-53.

King, PNEC Conferences, "1997 Update Bit Selection for Coiled Tubing Frilling" Jan. 3, 1997, pp. 1-15.

DeLucia, SPE 13026, "PDM vs. Turbodrill: a Drilling Comparison" pp. 2-7.

Black, SPE 13258, "PDC Bits Performance for Rotary, Mud Motor, and Turbine Drilling Applications" pp. 2-11.

Belaskie, et al., SPE Drilling & Completion, "Distinct Applications of MWD, Weight on Bit and Torque" Jun. 1993, pp. 111-112.

Bayoud, SPE/IASDC 18631 Drilling Conference, New Orleans, Louisiana, "Downhole Motors Increase ROP and Reduce Cost Per Foot in the Austin Chalk Trend" Feb. 28-Mar. 3, 1998.

* cited by examiner

STEERABLE DRILLING SYSTEM AND METHOD

RELATED CASE

This application is a continuation of application Ser. No. 10/230,709, filed Aug. 29, 2002, now U.S. Pat. No. 7,147,066, which is a continuation of application Ser. No. 09/378,023, filed Aug. 21, 1999, which issued as U.S. Pat. No. 6,581,699, which is a continuation-in-part of application Ser. No. 09/217,764, filed Dec. 21, 1998, which issued as U.S. Pat. No. 6,269,892.

FIELD OF THE INVENTION

The present invention relates to a steerable bottom hole assembly including a rotary bit powered by a positive displacement motor or a rotary steerable device. The bottom hole assembly of the present invention may be utilized to efficiently drill a deviated borehole at a high rate of penetration.

BACKGROUND OF THE INVENTION

Steerable drilling systems are increasingly used to controllably drill a deviated borehole from a straight section of a wellbore. In a simplified application, the wellbore is a straight vertical hole, and the drilling operator desires to drill a deviated borehole off the straight wellbore in order to thereafter drill substantially horizontally in an oil bearing formation. Steerable drilling systems conventionally utilize a downhole motor (mud motor) powered by drilling fluid (mud) pumped from the surface to rotate a bit. The motor and bit are supported from a drill string that extends to the well surface. The motor rotates the bit with a drive linkage extending through a bent sub or bent housing positioned between the power section of the motor and the drill bit. Those skilled in the art recognize that the bent sub may actually comprise more than one bend to obtain a net effect which is hereafter referred to for simplicity as a "bend" and associated "bend angle." The terms "bend" and "bend angle" are more precisely defined below.

To steer the bit, the drilling operator conventionally holds the drill string from rotation and powers the motor to rotate the bit while the motor housing is advanced (slides) along the borehole during penetration. During this sliding operation, the bend directs the bit away from the axis of the borehole to provide a slightly curved borehole section, with the curve achieving the desired deviation or build angle. When a straight or tangent section of the deviated borehole is desired, the drill string and thus the motor housing are rotated, which generally causes a slightly larger bore to be drilled along a straight path tangent to the curved section. U.S. Pat. No. 4,667,751, now RE 33,751, is exemplary of the prior art relating to deviated borehole drilling. Most operators recognize that the rate of penetration (ROP) of the bit drilling through the formation is significantly less when the motor housing is not rotated, and accordingly sliding of the motor with no motor rotation is conventionally limited to operations required to obtain the desired deviation or build, thereby obtaining an overall acceptable build rate when drilling the deviated borehole. Accordingly, the deviated borehole typically consists of two or more relatively short length curved borehole sections, and one or more relatively long tangent sections each extending between two curved sections.

Downhole mud motors are conventionally stabilized at two or more locations along the motor housing, as disclosed in U.S. Pat. No. 5,513,714, and WO 95/25872. The bottom hole assembly (BHA) used in steerable systems commonly employs two or three stabilizers on the motor to give directional control and to improve hole quality. Also, selective positioning of stabilizers on the motor produces known contact points with the wellbore to assist in building the curve at a predetermined build rate.

While stabilizers are thus accepted components of steerable BHAs, the use of such stabilizers causes problems when in the steering mode, i.e., when only the bit is rotated and the motor slides in the hole while the drill string and motor housing are not rotated to drill a curved borehole section. Motor stabilizers provide discrete contact points with the wellbore, thereby making sliding of the BHA difficult while simultaneously maintaining the desired WOB. Accordingly, drilling operators have attempted to avoid the problems caused by the stabilizers by running the BHA "slick," i.e., with no stabilizers on the motor housing. Directional control may be sacrificed, however, because the unstabilized motor can more easily shift radially when drilling, thereby altering the drilling trajectory.

Bits used in steerable assemblies commonly employ fixed PDC cutters on the bit face. The total gauge length of a drill bit is the axial length from the point where the forward cutting structure reaches full diameter to the top of the gauge section. The gauge section is typically formed from a high wear resistant material. Drilling operations conventionally use a bit with a short gauge length. A short bit gauge length is desired since, when in the steering mode, the side cutting ability of the bit required to initiate a deviation is adversely affected by the bit gauge length. A long gauge on a bit is commonly used in straight hole drilling to avoid or minimize any build, and accordingly is considered contrary to the objective of a steerable system. A long gauge bit is considered by some to be functionally similar to a conventional bit and a "piggyback" or "tandem" stabilizer immediately above the bit. This piggyback arrangement has been attempted in a steerable BHA, and has been widely discarded since the BHA has little or no ability to deviate the borehole trajectory. The accepted view has thus been that the use of a long gauge bit or a piggyback stabilizer immediately above a conventional short gauge bit, in a steerable BHA results in the loss of the drilling operator's ability to quickly change direction, i.e., they do not allow the BHA to steer or steering is very limited and unpredictable. The use of PDC bits with a double or "tandem" gauge section for steerable motor applications is nevertheless disclosed in SPE 39308 entitled "Development and Successful Application of Unique Steerable PDC Bits."

Most steerable BHAs are driven by a positive displacement motor (PDM), and most commonly by a Moineau motor which utilizes a spiraling rotor which is driven by fluid pressure passing between the rotor and stator. PDMs are capable of producing high torque, low speed drilling that is generally desirable for steerable applications. Some operators have utilized steerable BHAs driven by a turbine-type motor, which is also referred to as a turbodrill. A turbodrill operates under a concept of fluid slippage past the turbine vanes, and thus operates at a much lower torque and a much higher rotary speed than a PDM. Most formations drilled by PDMs cannot be economically drilled by turbodrills, and the use of turbodrills to drill curved boreholes is very limited. Nevertheless, turbodrills have been used in some steerable applications, as evidenced by the article "Steerable Turbodrilling Setting New ROP Records," OFFSHORE, August 1997, pp. 40 and 42. The action of the PDC bit powered by a PDM is also substantially different than the action of a PDC bit powered by a turbodrill because the turbodrill rotates the bit at a much higher speed and a much lower torque.

Turbodrills require a significant pressure drop across the motor to rotate the bit, which inherently limits the applications in which turbodrills can practically be used. To increase the torque in the turbodrill, the power section of the motor has to be made longer. Power sections of conventional turbodrills are often 30 feet or more in length, and increasing the length of the turbodrill power section is both costly and adversely affects the ability of the turbodrill to be used in steerable applications.

A rotary steerable device (RSD) can be used in place of a PDM. An RSD is a device that tilts or applies an off-axis force to the bit in the desired direction in order to steer a directional well, even while the entire drillstring is rotating. A rotary steerable system enables the operator to drill far more complex directional and extended-reach wells than ever before, including particularly targets that previously were thought to be impossible to reach with conventional steering assemblies. A rotary steerable system may provide the operator and the engineers, geologists, directional drillers and LWD operators with valuable real-time, continuous steering information at the surface, i.e., where it is most needed. A rotary steerable automated drilling system is a technology solution that may translate into significant savings in time and money.

Rotary steerable technology is disclosed in U.S. Pat. Nos. 5,685,379, 5,706,905, 5,803,185, and 5,875,859, and also in Great Britain reference 2,172,324, 2,172,325, and 2,307,533. Applicant also incorporates by reference herein U.S. application Ser. No. 09/253,599 filed Jul. 14, 1999 entitled "Steerable Rotary Drilling Device and Directional Drilling Method."

Automated, or self-correcting steering technology enables one to maintain the desired toolface and bend angle, while maximizing drillstring RPM and increasing ROP. Unlike conventional steering assemblies, the rotary steerable system allows for continuous rotation of the entire drillstring while steering. Steering while sliding with a PDM is typically accompanied by significant drag, which may limit the ability to transfer weight to the bit. Instead, a rotary steerable system is steered by tilting or applying an off-axis force at the bit in the direction that one wishes to go while rotating the drillpipe. When steering is not desired, one simply instructs the tool to turn off the bit tilt or off-axis force and point straight. Since there is no sliding involved with the rotary steerable system, the traditional problems related to sliding, such as discontinuous weight transfer, differential sticking and drag problems, are greatly reduced. With this technology, the well bore has a smooth profile as the operator changes course. Local doglegs are minimized and the effects of tortuosity and other hole problems are significantly reduced. With this system, one optimizes the ability to complete the well while improving the ROP and prolonging bit life.

A rotary steerable system has even further advantages. For instance, hole-cleaning characteristics are greatly improved because the continuous rotation facilitates better cuttings removal. Unlike positive differential mud motors, this system has no traditional, elastomer motor power section, a component subject to wear and environmental dependencies. By removing the need for a power section with the rotary steerable system, torque is coupled directly through the drillpipe from the surface to the bit, thereby resulting in potentially longer bit runs. Plus, this technology is compatible with virtually all types of continuous fluid mud systems.

Those skilled in the art have long sought improvements in the performance of a steerable BHA which will result in a higher ROP, particularly if a higher ROP can be obtained with better hole quality and without adversely affecting the ability of the BHA to reliably steer the bit. Such improvements in the BHA and in the method of operating the BHA would result in considerable savings in the time and money utilized to drill a well, particularly if the BHA can be used to penetrate farther into the formation before the BHA is retrieved to the surface for altering the BHA or for replacing the bit. By improving the quality of both the curved borehole sections and the straight borehole sections of a deviated borehole, the time and money required for inserting a casing in the well and then cementing the casing in place are reduced. The long standing goal of an improved steerable BHA and method of drilling a deviated borehole has thus been to save both time and money in the production of hydrocarbons.

SUMMARY OF THE INVENTION

An improved bottom hole assembly (BHA) is provided for controllably drilling a deviated borehole. The bottom hole assembly may include either a positive displacement motor (PDM) driven by pumping downhole fluid through the motor for rotating the bit, or the BHA may include a rotary steerable device (RSD) such that the bit is rotated by rotating the drill string at the surface. The BHA lower housing surrounding the rotating shaft is preferably "slick" in that it has a substantially uniform diameter housing outer surface without stabilizers extending radially therefrom. The housing on a PDM has a bend. The bend on a PDM occurs at the intersection of the power section central axis and the lower bearing section central axis. The bend angle on a PDM is the angle between these two axes. The housing on an RSD does not have a bend. The bend on an RSD occurs at the intersection of the housing central axis and the lower shaft central axis. The bend angle on an RSD is the angle between these two axes. The bottom hole assembly includes a long gauge bit, with the bit having a bit face having cutters thereon and defining a bit diameter, and a long cylindrical gauge section above the bit face. The total gauge length of the bit is at least 75% of the bit diameter. The total gauge length of a drill bit is the axial length from the point where the forward cutting structure reaches full diameter to the top of the gauge section. At least 50% of the total gauge length is substantially full gauge. Most importantly, the axial spacing between the bend and the bit face is controlled to less than twelve times the bit diameter.

According to the method of the invention, a bottom hole assembly is preferably provided with a slick housing having a uniform diameter outer surface without stabilizers extending radially therefrom. The bit is rotated at a speed of less than 350 rpm. The bit has a gauge section above the bit face such that the total gauge length is at least 75% of the bit diameter. At least 50% of the total gauge length is substantially full gauge. The axial spacing between the bend and the bit face is controlled to less than twelve times the bit diameter. When drilling the deviated borehole, a low WOB may be applied to the bit face compared to prior art drilling techniques.

It is an object of the present invention to provide an improved BHA for drilling a deviated borehole at a high rate of penetration (ROP) compared to prior art BHAs. This high ROP is achieved when either the PDM or the RSD is used in the rotation of the bit.

It is a related object of the invention to form a deviated borehole with a BHA utilizing improved drilling methods so that the borehole quality is enhanced compared to the borehole quality obtained by prior art methods. The improved borehole quality, including the reduction or elimination of borehole spiraling, results in higher quality formation evaluation logs and subsequently allows the casing or liner to be more easily slid through the deviated borehole.

It is an object of the present invention to provide an improved bottom hole assembly for drilling a deviated borehole, with the bottom hole assembly including a rotary shaft having a lower central axis offset at a selected bend angle from an upper central axis by a bend, a housing having a substantially uniform diameter outer surface enclosing a portion of the rotary shaft, and a long gauge bit powered by the rotary shaft. The long gauge bit has a bit face defining a bit diameter and a gauge section having a substantially uniform diameter cylindrical surface spaced above the bit face, with a total gauge length of at least 75% of the bit diameter. At least 50% of the total gauge length is substantially full gauge.

Another object of the invention is to provide an improved method of drilling a deviated borehole utilizing a bottom hole assembly which includes a rotary shaft having a lower central axis offset at a selected bend angle from an upper central axis by a bend, wherein the bottom hole assembly further includes a bit rotated by the rotary shaft and the method includes providing a housing having a substantially uniform diameter outer surface surrounding the rotary shaft upper axis, providing a long gauge bit having a gauge section with a substantially uniform diameter cylindrical surface and with a total gauge length of at least 75% of the bit diameter, at least 50% of the total gauge length being substantially full gauge, and rotating the bit at a speed of less the 350 rpm to form a curved section of the deviated borehole. A method of the present invention may be used with either a positive displacement motor (PDM) or with a rotary steerable device (RSD).

Another object of the present invention is to provide an improved bottomhole assembly for drilling a deviated borehole with a long gauge bit having a gauge section wherein the portion of the total gauge length that is substantially full gauge has a centerline, that centerline preferably having a maximum eccentricity of 0.03 inches relative to the centerline of the rotary shaft. This method may also be obtained by taking special precautions with respect to the use of a conventional bit and a piggyback stabilizer. An improved method of drilling a deviated borehole according to the present invention includes providing a bottomhole assembly that satisfies the above relationship.

Yet another object of this invention is to provide a bottom hole assembly for drilling a deviated borehole, wherein the long gauge bit is powered by rotating the shaft, and one or more sensors positioned substantially along the total gauge length of the long gauge bit or elsewhere in the BHA for sensing selected parameters while drilling. Signals from these sensors may then be used by the drilling operator to improve the efficiency of the drilling operation. According to the related method, information from the sensors may be provided in real time to the drilling operator, and the operator may then better control drilling parameters such as weight on bit while rotating the bit at a speed of less than 350 rpm to form a curved section of the deviated borehole.

Still another object of the invention is to provide an improved bottom hole assembly for drilling a deviated borehole, wherein the rotary shaft which passes through the bend is rotated at the surface. A long gauge bit is provided with a gauge section such that the total gauge length is at least 75% of the bit diameter and at least 50% of the total gauge length is substantially full gauge. The axial spacing between the bend and the bit face is less than twelve times the bit diameter. According to the related method of this invention, the drilling operator is able to improve drilling efficiency while rotating the bit at a speed of less than 350 rpm to form a curved section of the deviated borehole.

It is a feature of the invention to provide a method for drilling a deviated borehole wherein the weight-on-bit (WOB) as measured at the surface is substantially reduced and more consistent compared to prior art systems by eliminating the drag normally attributable to conventional BHAs.

Another feature of the invention is a method of drilling a deviated borehole wherein a larger portion of the deviated borehole may be drilled with the motor sliding and not rotating compared to prior art methods. The length of the curved borehole sections compared to the straight borehole sections may thus be significantly increased. The bit may also be rotated from the surface, with a bend being provided in an RSD.

Another feature of the invention is that hole cleaning is improved over conventional drilling methods due to improved borehole quality.

It is also a feature of the invention to improve borehole quality by providing a BHA for powering a long gauge bit which reduces bit whirling and hole spiraling. A related feature of the invention achieves a reduction in the bend angle to reduce both spiraling and whirling. The reduced bend angle in the housing of a PDM reduces stress on the housing and minimizes bit whirling when drilling a straight tangent section of the deviated borehole. The reduced bend BHA nevertheless achieves the desired build rate because of the short distance between the bend and the bit face.

It is a feature of the present invention that a bottom hole assembly may have an axial spacing between the bend and the bit face of less than twelve times the bit diameter. A related feature of this invention is that this reduced spacing may be obtained in part by providing a pin connection at a lowermost end of the rotary shaft and a mating box connection at the uppermost end of a long gauge bit.

Another feature of the invention is that the axial spacing between the bend and the bit face may be held to less than twelve times the bit diameter, and the bend may be less than 0.6 degrees when using a RSD.

Still another feature of this invention is that the axial spacing between the bend and the bit face may be held to less than twelve times the bit diameter, with the bend being less than 1.5 degrees in a PDM. The motor housing may be rotated with the drill pipe to form a straight section of a deviated borehole.

Still another feature of this invention is that the bottom hole assembly may be provided with one or more downhole sensors positioned substantially along the length of the total gauge length or elsewhere in the BHA for sensing any desired borehole parameter.

Yet another feature of the present invention is that improved techniques may be used with a PDM, so that the method includes rotating the motor housing within the borehole to rotate the bit when forming a straight section of the deviated borehole.

The improved method of the invention preferably includes controlling the actual weight on the bit such that the bits face exerts less than about 200 pounds axial force per square inch of the PDC bit face cross-sectional area.

According to the method of this invention, the bend may be maintained to less than 1.5 degrees when using a PDM, and a bit may be rotated at less than 350 rpm.

Yet another feature of the invention is that the one or more sensors may be provided substantially along the total gauge length of the bit and/or bit and stabilizer. These sensors may include a vibration sensor and/or a rotational sensor for sensing the speed of the rotary shaft.

Still another feature of this invention is that an MWD sub may be located above the motor, and a short hop telemetry system may be used for communicating data from the one or more sensors in real time to the MWD sub. The short hop telemetry system may be either an acoustic system or an electromagnetic system.

Yet another feature of the invention is that data from the sensors may be stored within the total gauge length of the long gauge bit and then output to a computer at the surface.

Still another feature of the invention is that the output from the one or more sensors provides input to the drilling operator either in real time or between bit runs, so that the drilling operator may significantly improve the efficiency of the drilling operation and/or the quality of the drilled borehole.

It is an advantage of the present invention that the spacing between the bend in a PDM or RSD and the bit face may be reduced by providing a rotating shaft having a pin connection at its lowermost end for mating engagement with a box connection of a long gauge bit. This connection may be made within the long gauge of the bit to increase rigidity.

Another advantage of the invention is that a relatively low torque PDM may be efficiently used in the BHA when drilling a deviated borehole. Relatively low torque requirements for the motor allow the motor to be reliably used in high temperature applications. The low torque output requirement of the PDM may also allow the power section of the motor to be shortened.

A significant advantage of this invention is that a deviated borehole is drilled while subjecting the bit to a relatively consistent and low actual WOB compared to prior art drilling systems. Lower actual WOB contributes to a short spacing between the bend and the bit face, a low torque PDM and better borehole quality.

It is also an advantage of the present invention that the bottom hole assembly is relatively compact. Sensors provided substantially along the total gauge length may transmit signals to a measurement-while-drilling (MWD) system, which then transmits borehole information to the surface while drilling the deviated borehole, thus further improving the drilling efficiency.

A significant advantage of this invention is that the BHA results in surprisingly low axial, radial and torsional vibrations to the benefit of all BHA components, thereby increasing the reliability and longevity of the BHA.

Still another advantage of the invention is that the BHA may be used to drill a deviated borehole while suspended in the well from coiled tubing.

Yet another advantage of the present invention is that a drill collar assembly may be provided above the motor, with a drill collar assembly having an axial length of less than 200 feet.

Another advantage of this invention is that when the techniques are used with a PDM, the bend may be less than about 1.5 degrees. A related advantage of the invention is that when the techniques are used with a RSD, the bend may be less than 0.6 degrees.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
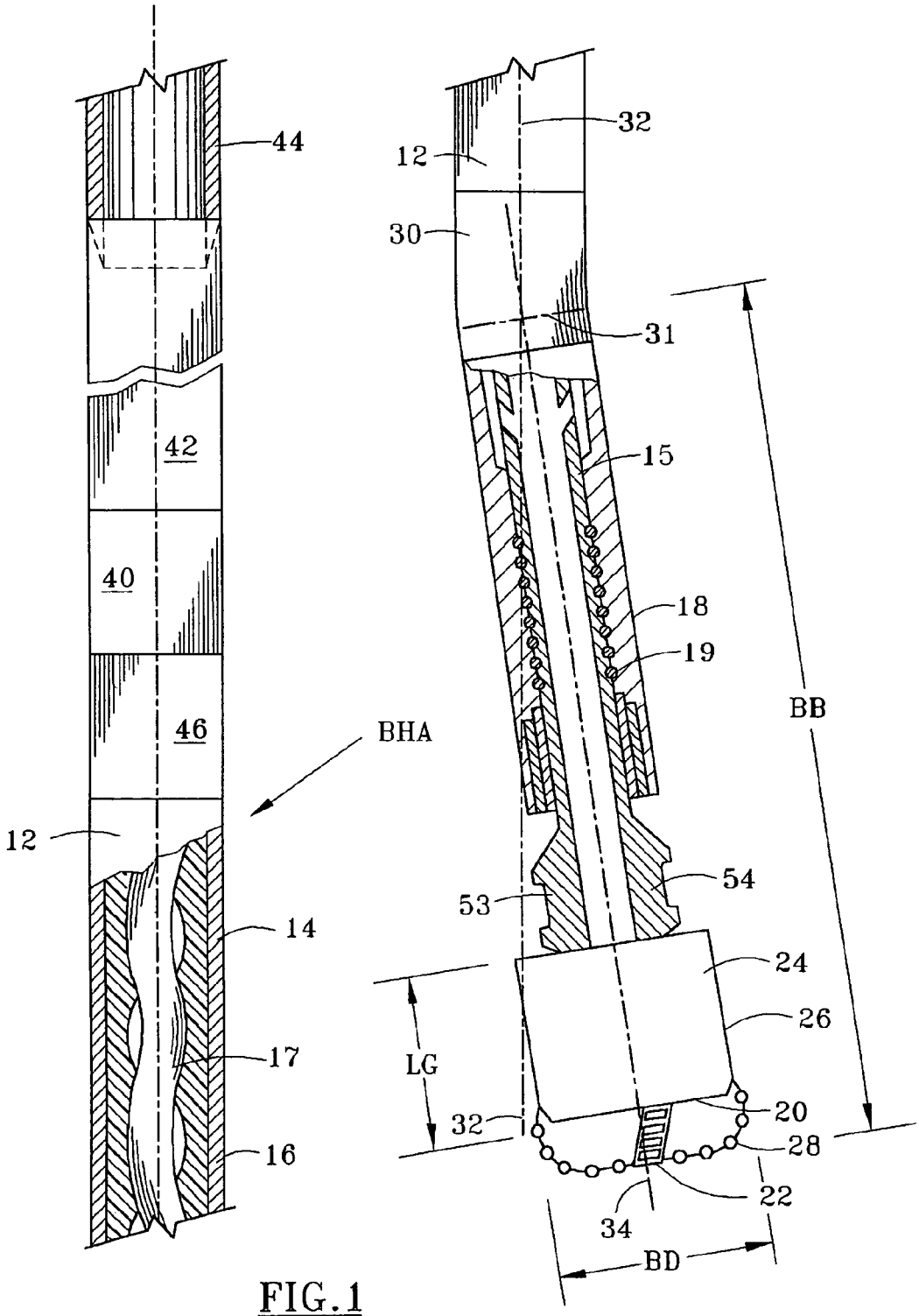
FIG. 1 is a general schematic representation of a bottom hole assembly according to the present invention for drilling a deviated borehole.

FIG. 1 depicts a bottom hole assembly (BHA) for drilling a deviated borehole. The BHA consists of a PDM 12 which is conventionally suspended in the well from the threaded tubular string, such as a drill string 44, although alternatively the PDM of the present invention may be suspended in the well from coiled tubing, as explained subsequently. PDM 12 includes a motor housing 14 having a substantially cylindrical outer surface along at least substantially its entire length. The motor has an upper power section 16 which includes a conventional lobed rotor 17 for rotating the motor output shaft 15 in response to fluid being pumped through the power section 16. Fluid thus flows through the motor stator to rotate the axially curved or lobed rotor 17. A lower bearing housing 18 houses a bearing package assembly 19 which comprising both thrust bearings and radial bearings. Housing 18 is provided below bent housing 30, such that the power section central axis 32 is offset from the lower bearing section central axis 34 by the selected bend angle. This bend angle is exaggerated in FIG. 1 for clarity, and according to the present invention is less than about 1.5°. FIG. 1 also simplistically illustrates the location of an MWD system 40 positioned above the motor 12. The MWD system 40 transmits signals to the surface of the well in real time, as discussed further below.

The BHA also includes a drill collar assembly 42 providing the desired weight-on-bit (WOB) to the rotary bit. The majority of the drill string 44 comprises lengths of metallic drill pipe, and various downhole tools, such as cross-over subs, stabilizer, jars, etc., may be included along the length of the drill string.

The term "motor housing" as used herein means the exterior component of the PDM 12 from at least the uppermost end of the power section 16 to the lowermost end of the lower bearing housing 18. As explained subsequently, the motor housing does not include stabilizers thereon, which are components extending radially outward from the otherwise cylindrical outer surface of a motor housing which engage the side walls of the borehole to stabilize the motor. These stabilizers functionally are part of the motor housing, and accordingly the term "motor housing" as used herein would include any radially extending components, such as stabilizers, which extend outward from the otherwise uniform diameter cylindrical outer surface of the motor housing for engagement with the borehole wall to stabilize the motor.

The bent housing 30 thus contains the bend 31 that occurs at the intersection of the power section central axis 32 and the lower bearing section central axis 34. The selected bend angle is the angle between these axes. In a preferred embodiment, the bent housing 30 is an adjustable bent housing so that the angle of the bend 31 may be selectively adjusted in the field by the drilling operator. Alternatively, the bent housing 30 could have a bend 31 with a fixed bend angle therein.

The BHA also includes a rotary bit 20 having a bit end face 22. A bit 20 of the present invention includes a long gauge section 24 with a substantially cylindrical outer surface 26 thereon. Fixed PDC cutters 28 are preferably positioned about the bit face 22. The bitface 22 is integral with the long gauge section 24. The total gauge length of the bit is at least 75% of the bit diameter as defined by the fullest diameter of the cutting end face 22, and preferably the total gauge length is at least 90% of the bit diameter. In many applications, the bit 20 will have a total gauge length from one to one and one-half times the bit diameter. The total gauge length of a drill bit is the axial length from the point where the forward cutting structure reaches full diameter to the top of the gauge section 24, which substantially uniform cylindrical outer surface 26 is parallel to the bit axis and acts to stabilize the cutting structure laterally. The long gauge section 24 of the bit may be slightly undersized compared to the bit diameter. The substantially uniform cylindrical surface 26 may be slightly tapered or stepped, to avoid the deleterious effects of tolerance stack up if the bit is assembled from one or more separately machined pieces, and still provide lateral stability to the cutting structure. To further provide lateral stability to the cutting structure, at least 50% of the total gauge length is considered substantially full gauge.

The preferred drill bit may be configured to account for the strength, abrasivity, plasticity and drillability of the particular rock being drilled in the deviated hole. Drilling analysis systems as disclosed in U.S. Pat. Nos. 5,704,436, 5,767,399 and 5,794,720 may be utilized so that the bit utilized according to this invention may be ideally suited for the rock type and drilling parameters intended. The long gauge bit acts like a near bit stabilizer which allows one to use lower bend angles and low WOB to achieve the same build rate.

It should also be understood that the term "long gauge bit" as used herein includes a bit having a substantially uniform outer diameter portion (e.g., 8½ inches) on the cutting structure and a slightly undersized sleeve (e.g., 8 15/32 inch diameter). Also, those skilled in the art will understand that a substantially undersized sleeve (e.g., less than about 8¼ inches) likely would not serve the intended purpose.

The improved ROP in conjunction with the desired hole quality along the deviated borehole achieved by the BHA is obtained by maintaining a short distance between the bend 31 and the bit face 22. According to the present invention, this axial spacing along the lower bearing section central axis 34 between the bend 31 and the bit face 22 is less than twelve times the bit diameter, and preferably is less than about eight times the bit diameter. This short spacing is obviously also exaggerated in FIG. 1, and those skilled in the art appreciate that the bearing pack assembly is axially much longer and more complex than depicted in FIG. 1. This low spacing between the bend and the bit face allows for the same build rate with less of a bend angle in the motor housing, thereby improving the hole quality.

Figures 2, 3:
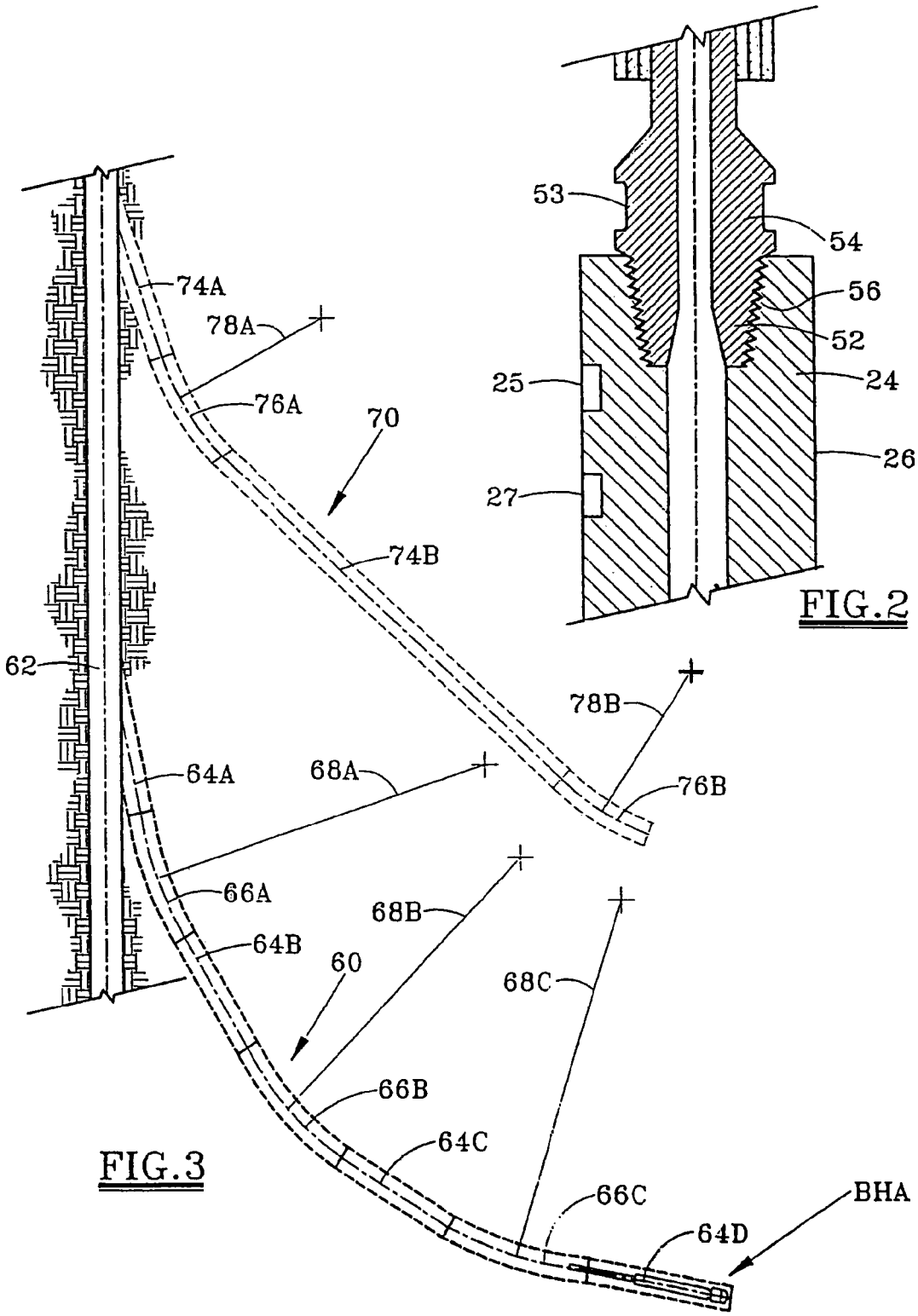
FIG. 2 illustrates a side view of the upper portion of a long gauge drill bit as generally shown in FIG. 1 and the interconnection of the box up drill bit with the lower end of a pin down shaft of a positive displacement motor.
FIG. 3 illustrates the bit trajectory when drilling a deviated borehole according to a preferred method of the invention, and illustrates in dashed lines the more common trajectory of the drill bit when drilling a deviated borehole according to the prior art.

In order to reduce the distance between the bend and the bit face, the PDM motor is preferably provided with a pin connection 52 at the lowermost end of the motor shaft 54, as shown in FIG. 2. The combination of a pin down motor and a box end 56 on the long gauge bit 20 thus allows for a shorter bend to bit face distance. The lowermost end of the motor shaft 54 extending from the motor housing includes radially opposing flats 53 for engagement with a conventional tool to temporarily prevent the motor shaft from rotating when threading the bit to the motor shaft. To shorten the length of the bearing pack assembly 19, metallic thrust bearings and metallic radial bearings may be used rather than composite rubber/metal radial bearings. In PDM motors, the length of the bearing pack assembly is largely a function of the number of thrust bearings or thrust bearing packs in the bearing package, which in turn is related to the actual WOB. By reducing the actual WOB, the length of the bearing package and thus the bend to bit face distance may be reduced. This relationship is not valid for a turbodrill, wherein the length of the bearing package is primarily a function of the hydraulic thrust, which in turn relates to the pressure differential across the turbodrill. The combination of the metallic bearings and most importantly the short spacing between the bend and the lowermost end of the motor significantly increases the stiffness of this bearing section 18 of the motor. The short bend to bit face distance is important to the improved stability of the BHA when using a long gauge bit. This short distance also allows for the use of a low bend angle in the bent housing 30 which also improves the quality of the deviated borehole.

The PDM is preferably run slick with no stabilizers for engagement with the wall of the borehole extending outward from the otherwise uniform diameter cylindrical outer surface of the motor housing. The PDM may, however, incorporate a slide or wear pad. The motor of the present invention rotates a long gauge bit which, according to conventional teachings, would not be used in a steerable system due to the inability of the system to build at an acceptable and predictable rate. It has been discovered, however, that the combination of a slick PDM, a short bend to bit face distance, and a long gauge bit achieve both very acceptable build rates and remarkably predictable build rates for the BHA. By providing the motor slick, the WOB, as measured at the surface, is significantly reduced since substantial forces otherwise required to stabilize the BHA within the deviated borehole while building are eliminated. Very low WOB as measured at the surface compared to the WOB used to drill with prior art BHAs is thus possible according to the method of the invention since the erratic sliding forces attributed to the use of stabilizers or pads on the motor housing are eliminated. Accordingly, a comparatively low and comparatively constant actual WOB is applied to the bit, thereby resulting in much more effective cutting action of the bit and increasing ROP. This reduced WOB allows the operator to drill farther and smoother than using a conventional BHA system. Moreover, the bend angle of the PDM is reduced, thereby reducing drag and thus reducing the actual WOB while drilling in the rotating mode.

BHA modeling has indicated that surface measured WOB for a particular application may be reduced from approximately 30,000 lbs to approximately 12,000 lbs merely by reducing the bend to bit face distance from about eight feet to about five feet. In this application, the bit diameter was 8½ inches, and the diameter of the mud motor was 6¾ inches. In an actual field test, however, the BHA according to the present invention with a slick PDM and a long gauge bit, with the reduced five feet spacing between the bend and the bit face, was found to reliably build at a high ROP with a WOB as measured at the surface of about 3,400 lbs. Thus the actual WOB was about one-ninth the WOB anticipated by the model using the prior art BHA. The actual WOB according to the method of this invention is preferably maintained at less than 200 pounds of axial force per square inch of bit face cross-sectional area, and frequently less than 150 pounds of axial force per square inch of a PDC bit face cross-sectional area. This area is determined by the bit diameter since the bit face itself may be curved, as shown in FIG. 1.

A lower actual WOB also allows the use for a lower torque PDM and a longer drilling interval before the motor will stall out while steering. Moreover, the use of a long gauge bit powered by a slick motor surprisingly was determined to build at very acceptable rates and be more stable in predicting build than the use of a conventional short gauge bit powered by a slick motor. Sliding ROP rates were as high as 4 to 5 times the sliding ROP rates conventionally obtained using prior art techniques. In a field test, the ROP rates were 100 feet per hour in rotary (motor housing rotated) and 80 feet per hour while sliding (motor housing oriented to build but not rotated). The time to drill a hole was cut to approximately one quarter and the liner thereafter slid easily in the hole.

The use of the long gauge bit is believed to contribute to improved hole quality. Hole spiraling creates great difficulties when attempting to slide the BHA along the deviated borehole, and also results in poor hole cleaning and subsequent poor logging of the hole. Those skilled in the art have traditionally recognized that spiraling is minimized by stabilizing the motor. The concept of the present invention contradicts conventional wisdom, and high hole quality is obtained by running the motor slick and by using the long gauge bit at the end of the motor with the bend to bit face distance being minimized.

The high quality and smooth borehole are believed to result from the combination of the short bend to bit spacing and the use of a long gauge bit to reduce bit whirling, which contributes to hole spiraling. Hole spiraling tends to cause the motor to "hang-and-release" within the drilled hole. This erratic action, which is also referred to as axial "stick-slip," leads to inconsistent actual WOB, causes high vibration which decreases the life of both the motor and the bit, and detracts from hole quality. A high ROP is thus achieved when drilling a deviated borehole in part because a large reserve of motor torque, which is a function of the WOB, is not required to overcome this axial stick-slip action and prevent the motor from stalling out. By eliminating hole spiraling, the casing subsequently is more easily slid into the hole. The PDM rotates the motor at a speed of less than 350 rpm, and typically less than 200 rpm. With the higher torque output of a PDM compared to that of a turbodrill, one would expect more bit whirling, but that has not proven to be a significant problem. Surprisingly high ROP is achieved with a very low WOB for a BHA with a PDM, with little bit whirling and no appreciable hole spiraling as evidenced by the ease of inserting the casing through the deviated borehole. Any bit whirling which is experienced may be further reduced or eliminated by minimizing the walk tendency of the bit, which also reduces bit whirling and hole spiraling. Techniques to minimize bit walking as disclosed in U.S. Pat. No. 5,099,929 may be utilized. This same patent discloses the use of heavy set, non-aggressive, relatively flat faced drill bits to limit torque cyclicity. Further modifications to the bit to reduce torque cyclicity are disclosed in a paper entitled "1997 Update, Bit Selection For Coiled Tubing Drilling" by William W. King, delivered to the PNEC Conference in October of 1997. The techniques of the present invention may accordingly benefit by drilling a deviated borehole at a high ROP with reduced torque cyclicity. Drill bits with whirl resistant features are also disclosed in a brochure entitled "FM 2000 Series" and "FS 2000 Series."

Bit Design

The IADC dull bit classification uses wear and damage criteria. It is generally acknowledged by bit designers that impact damage has a major effect on bit life, either by destroying the cutting structure, or by weakening it such that wear is accelerated. Observation of the results of runs with the present invention shows that bit life is greatly extended in comparison with similar sections drilled with conventional motors and bits, regardless of the cause of such extension. Observation of downhole vibration sensors shows significantly reduced vibration of bits, i.e. bit impact, a prime cause of cutter damage, is greatly reduced when using the concepts of this invention.

Examination of the bits used with the BHA of this invention should show a significantly higher rating for cutter wear than for cutter damage. Comparison with "dull gradings" of conventional bits shows that, for comparable wear, conventional bits have higher damage ratings compared to bits using a BHA of this invention. This proves that bit life is extended by the present invention through markedly reduced vibration characteristics of the bit. Whirl analysis further lends weight to why this should be so, in addition to the merits of long gauge bits. The intention of drilling is to make a hole (with a diameter determined by the cutting structure) by removing formation from the bottom of the hole. "Sidecutting" is therefore superfluous. WOB required to drill is generally far less than indicated by surface WOB, and there is not invariably instant weight transfer to bottom as soon as the string is rotated. This has implications, specifically for a bearing pack that carries 17,000 lbf.

It was widely believed that maximum rates of penetration are obtained by maximizing cutting torque demand, commonly by increasing the "aggressiveness" of the bit, and maximizing motor output torque to meet this demand. "Aggressiveness" is a common feature of bit specs and bit advertising. High motor output torque is also heavily emphasized. Maximizing WOB is also widely seen as a key to maximizing performance. The results obtained from the present invention contradict these contentions. Maximum rates of penetration to date have been obtained with "non-aggressive" (or at least significantly less aggressive than would normally be chosen) bits. The motors that have performed best have been (relatively) low torque models, and surprisingly low levels of WOB have been needed. This suggests that the drilling mechanism of the present invention is significantly different from that of a conventional motor and bit.

A further difference between the present invention and conventional wisdom is that, almost universally, a short gauge length and an aggressive sidecutting action are seen as desirable features of a bit with a good directional performance. Again these features are a common feature of advertising, and manufacturers may offer a range of "directional" bits with a noticeably abbreviated gauge length, roughly one third that of a conventional short gauge bit. The bits preferably used according to the present invention are designed to have a gauge length some 10 to 12 times that of a directional bit and to have low sidecutting performance. Nonetheless, they at worst are equal, and at best far out-perform conventional "directional" bits. A preferred BHA configuration may consist of a bit, a slick motor and MWD with no stabilizer.

Figure 4:
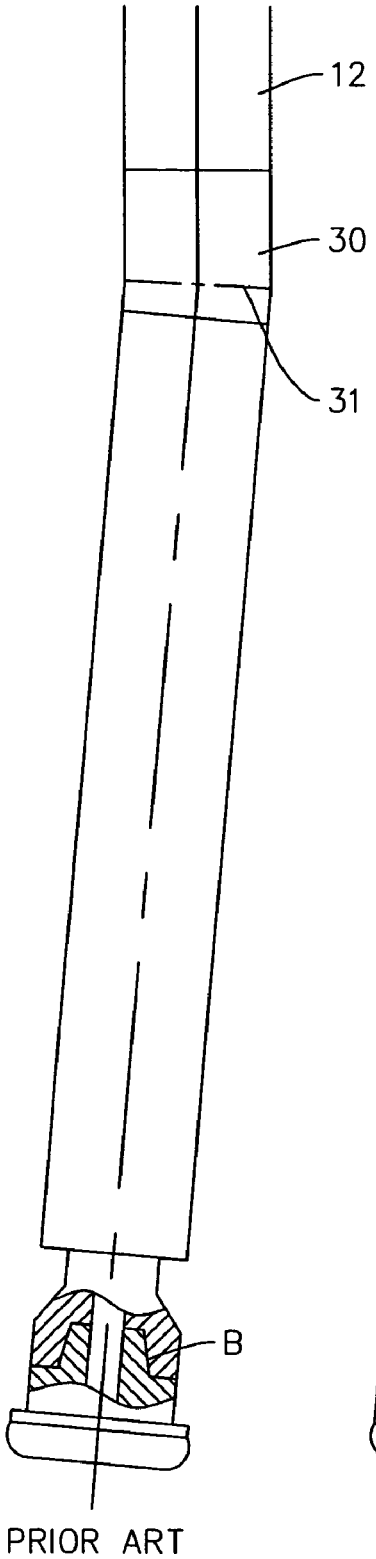
FIG. 4 is a simplified schematic view of a conventional bottom hole assembly (BHA) according to the present invention with a conventional motor and a conventional bit.
Figure 5:
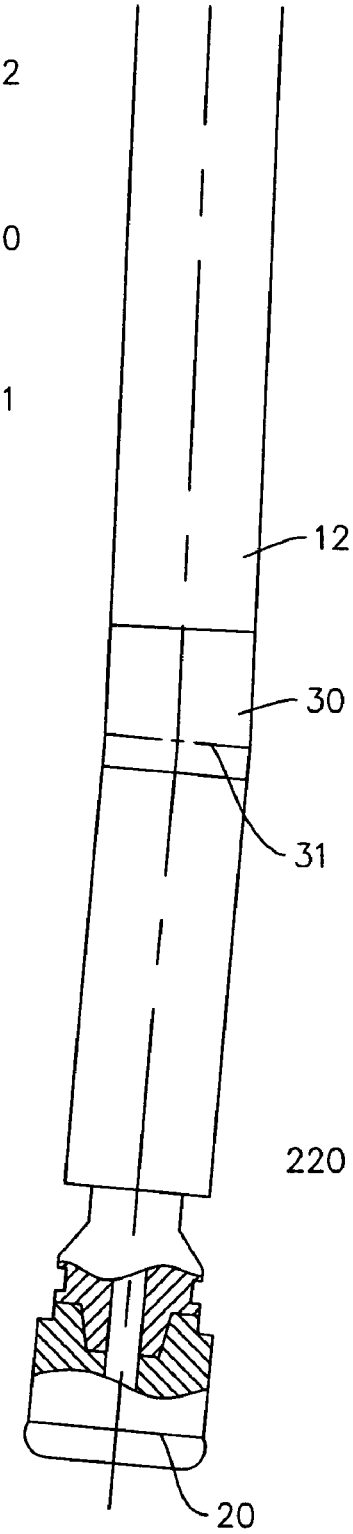
FIG. 5 is a simplified schematic view of a BHA according to the present invention with a bend in motor being near the long gauge bit.
Figure 6:
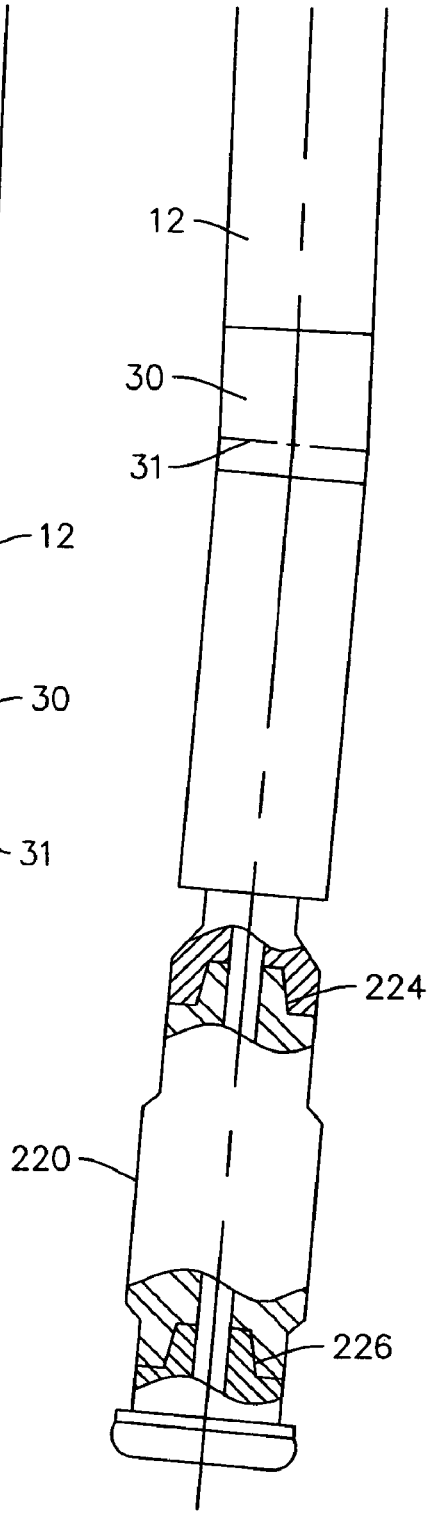
FIG. 6 is a simplified schematic view of an alternate BHA according to the present invention with a bend in the motor being adjacent to a conventional bit with a piggyback stabilizer.

FIG. 4 illustrates a conventional BHA assembly, including a motor 12 with a bent housing 30 rotating a conventional bit B. A conventional motor assembly consists of a regular (pin-end) bit connected to the drive shaft of the motor. Due to the fact that the bit is not well-supported and in view of the conventional manufacturing tolerance between the drive shaft and motor body, a conventional motor system is prone to lateral vibration during drilling. FIG. 5 illustrates a BHA of the present invention, wherein the motor 12 has a bent housing 30 rotating a long gauge bit 20. The bend 31 is thus much closer to the bit than in the FIG. 4 embodiment. A preferred configuration according to this invention consists of a long gauge (box) bit and a pin-end motor. Due to the long gauge, the bit is not only supported at the bit head but also at the gauge. This results in much better lateral stability, less vibration, higher build rate, etc. One could replace the long gauge bit with a conventional bit and a stabilizer sub such as "the piggyback". FIG. 6 shows a BHA, with the motor 12 rotating a piggyback stabilizer 220 as discussed more fully below. The drawbacks of this configuration are twofold. First, it will increase the bit to bend distance. Second, it will introduce vibrations due to rotating misalignment.

In FIG. 6, the piggyback stabilizer 220 has a portion of its outer diameter that forms a substantially uniform cylindrical outer surface which acts to laterally stabilize the bit cutting structure, which in effect is the gauge section. For the bit plus piggyback stabilizer configuration, the total gauge length is the axial length from the point where the forward cutting structure of the bit reaches full diameter to the top of the gauge section on the piggyback stabilizer. The total gauge length is at least 75% of the bit diameter, is preferably at least 90% of the bit diameter. In many applications, the total gauge length will be from one to one and one-half times the bit diameter. At least 50% of the total gauge length is substantially full gauge, e.g., at least a portion of the total gauge length may be slightly undersized relative to the bit diameter by approximately 1/32nd inch.

A motor plus a box connection long gauge bit has two half connections. In FIG. 6, the short bit plus piggyback stabilizer configuration has two connections, 224 and 226, or four half connections. Each half connection has associated tolerances in diameter, concentricity, and alignment, and these can stack up. Maximum stiffness and minimum stack up belong to a long gauge box connection bit. Ergo, maximum stiffness and minimum imbalance are preferably used according to the present invention. The net result is that piggybacks generally are unbalanced and thus could produce additional bit vibrations. Nevertheless, one could manufacture a short, very-balanced piggyback, which may produce the same results as those from the long gauge bit. However, the manufacturing cost and the higher service costs to maintain this alternative must be considered. More particularly, higher machining costs to reduce the tolerance stacking problem and/or special truing techniques to shape the outer surface of the piggyback may be employed to meet this objective.

Under normal machining shop practice, the maximum eccentricity between the connection and gauge diameter on standard bits is limited to 0.01" (e.g., for a 8.5 inch diameter bit). For both the FIG. 4 and FIG. 5 embodiments, this 0.01 inch maximum tolerance is the same for these two bits and should be consistent with the API specifications. Under normal machining shop practice, the gauge section of the piggyback stabilizer may be eccentric to the centerline of the bit and rotary shaft by 0.25 inches or more. By taking special precautions during the manufacturing of the piggyback stabilizer, the bit plus piggyback stabilizer configuration can be made such that the portion of the total gauge length that is substantially full gauge has a centerline, that centerline preferably having a maximum eccentricity of 0.03 inches relative to the centerline of the rotary shaft.

BHA Advantages

The BHA of the present invention has the following advantages over conventional motor assemblies: (1) improved steerability; (2) reduced vibrations; and (3) improved wellbore quality and reduced hole tortuosity. The reasons this BHA works so well may be summarized into three mechanisms: (1) The long gauge bit acts like a near bit stabilizer which stabilizes the bit and stiffens the bit to bend section; (2) Shortened bit to bend distances prevent the bent housing from touching the wellbore wall; and (3) Lower mud motor bend angles and reduced WOB act to reduce the torque at bit.

The working principles may be summarized as follows:

- The bit is stabilized on its gauge section and hence there is little or no contact between the bent housing and the wellbore wall.
- The next point of contact above the bit is either the smooth OD of a drill collar or a stabilizer.
- Because the bit is stabilized and the next point of contact is much higher in the BHA of this invention, this in effect limits hole spiraling and bit vibrations without adding more drag to the BHA.

Using the same principles as above, it is clear that the bit face to bend length is critical. The shorter the bit face to bend distance, the less chance there is that the bent housing can come in contact with the wellbore wall. Additionally, the shorter the bit face to bend distance, lower bend angles and lower WOB may be used to achieve as high or higher build rates than conventional BHA assemblies. Yet lower bend angles also contribute to the smoothness of the borehole.

Modeling indicates that the mud motor would be sitting at the bent housing during oriented drilling, if a conventional bit was used at the end of a pin-down slick motor (with no support at the bit gauge). So even in a smooth wellbore, higher loading per unit area on the wear pad would likely cause some resistance to sliding resulting in higher drag and poor steerability. Rotating an unstabilized motor may create vibration and high torque as impact may occur once in every revolution of the drillstring. The bigger the bend, the higher the torque fluctuation and larger the energy loss. Results from the field test demonstrate no such phenomenon, thus confirming the working principles of the present invention.

Figure 7:
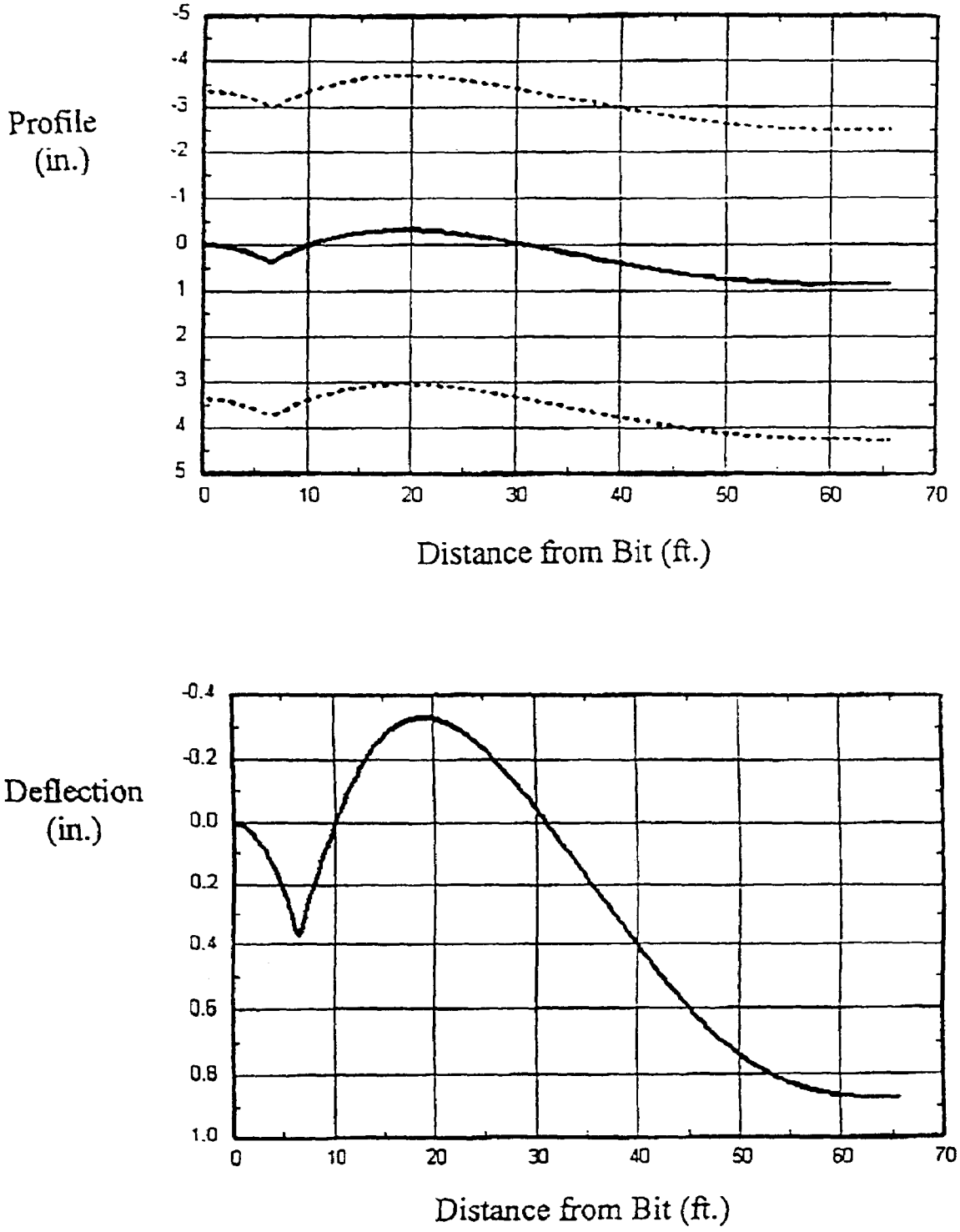
FIG. 7 is a graphic model of profile and deflection as a function of distance from bend to bit face for an application involving no borehole wall contact with a PDM.
Figure 8:
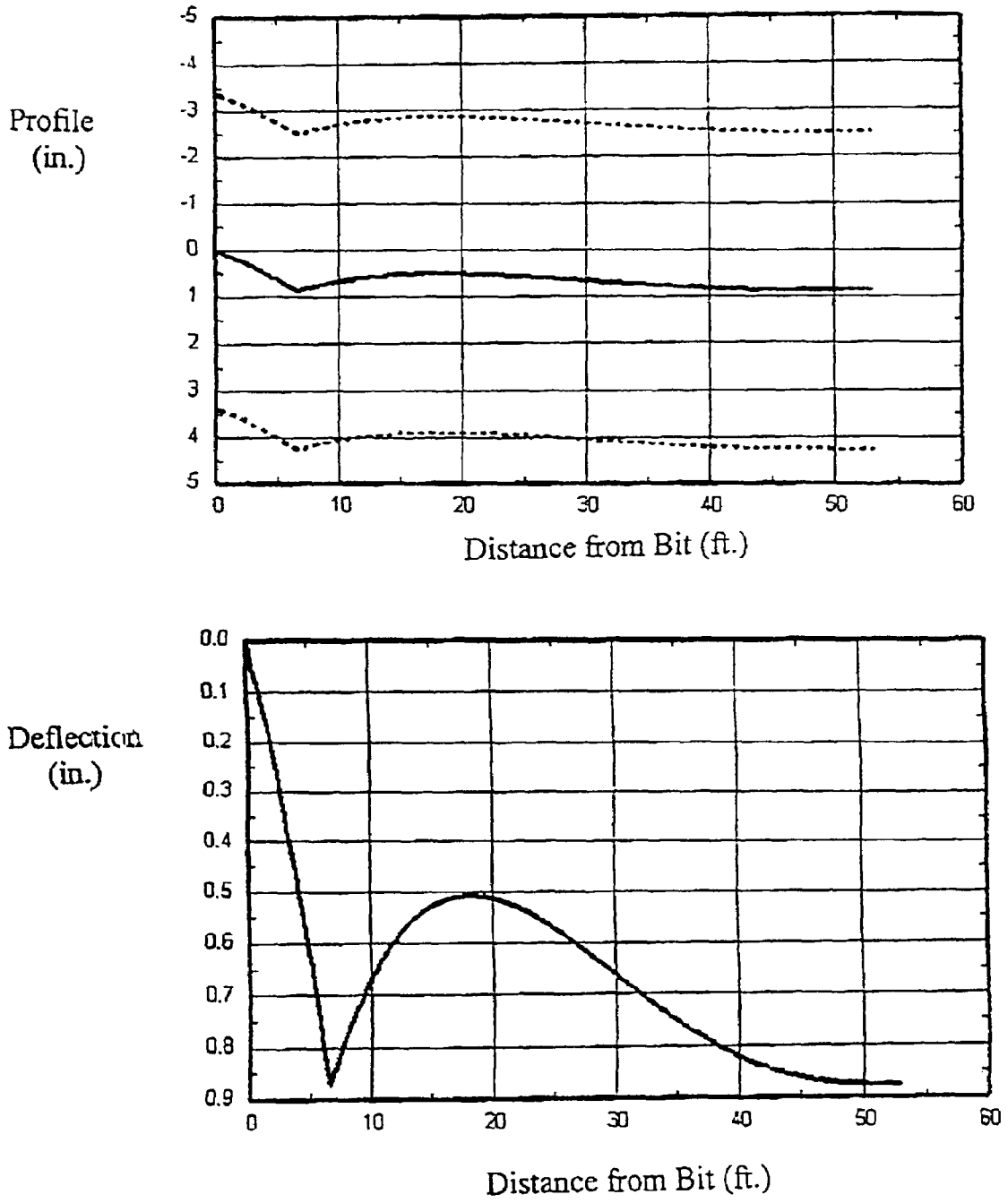
FIG. 8 is a graphic model of profile and deflection as a function of distance from bend to bit face for an application involving contact of the motor with the borehole wall.

FIG. 7 illustrates the profile and deflection of a BHA according to the present invention when sliding at high side orientation. The key parameters include a 1.15° adjustable bent hosing ("ABH") mud motor, a 6.51 foot bit face to bend distance (9.2 times the bit diameter), and a 12 inch total gauge length (1.4 times the bit diameter). The maximum deflection was about 0.4 inches near the bent housing. The radial clearance was about 0.875 inches, so the bent housing was not in contact with the borehole wall (see the profile graphic in FIG. 7). FIG. 8 shows the profile and deflection for a pin down motor with a short gauge box up PDC bit. All the BHA parameters are the same except for the bit total gauge length which was reduced from 12 inches to 6 inches (0.7 times the bit diameter). The mud motor bent housing depicted is clearly contacting the wellbore wall. This phenomenon may have added significant drag to the BHA and reduced steerability. Increased vibration may have been seen during any rotated sections.

Figures 12, 13, 14:
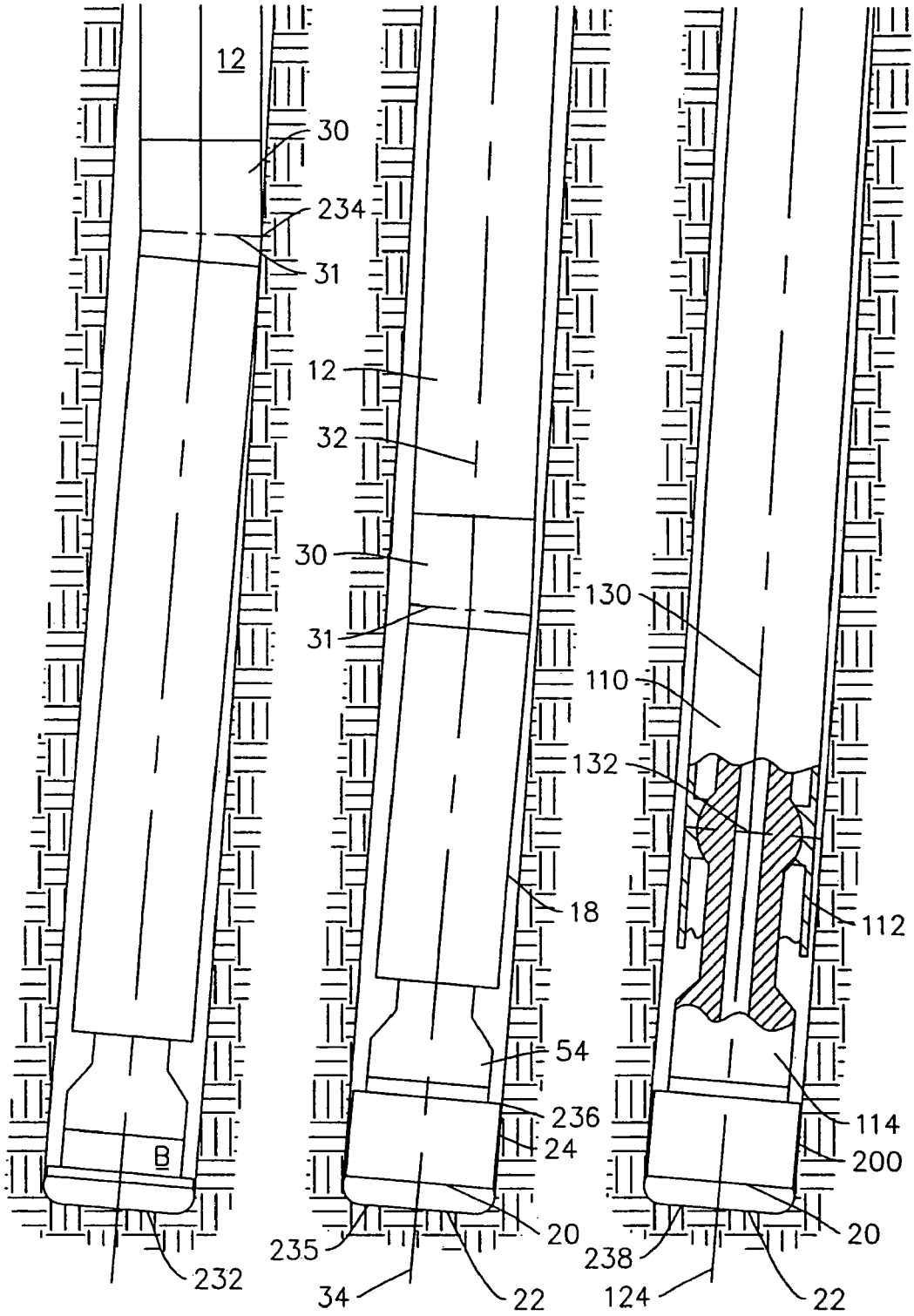
FIG. 12 is a simplified schematic representation of a conventional steerable BHA in a deviated wellbore.
FIG. 13 is a simplified schematic representation of a BHA with a PDM according to the present invention in a deviated wellbore.
FIG. 14 is a simplified schematic representation of a BHA with an RSD according to the present invention in a deviated wellbore.

The working principles of the present invention can be furthered illustrated in FIGS. 12 to 14. In FIG. 12, the conventional PDM 12 has a bend to bit face length that exceeds the limit of twelve times the bit diameter of the present invention. The total gauge length is also less than the required minimum length of 0.75 times the bit diameter of the present invention. The first point of contact 232 between the BHA and the wellbore is at the bit face. The second point of contact 234 between the BHA and the wellbore is at the bend. The curvature of the wellbore is defined by these two points of contact as well as a third point of contact (not shown) between the BHA and the wellbore higher up on the BHA.

The curvature of the wellbore in FIG. 13 is approximately the same as FIG. 12. The PDM 12 in FIG. 13 is modified such that the bend 31 to bit face 22 length is less than the limit of twelve times the bit diameter. The total gauge length of the bit is longer than the required minimum length of 0.75 times the bit diameter and at least 50% of the total gauge length is substantially full gauge. In FIG. 13, the bend angle between the central axis of the lower bearing section 34 and the central axis of the power section 32 is reduced compared with FIG. 12. The first point of contact between the BHA and the wellbore is at the bit face 235, and (moving upward), the second point of contact 236 is at the upper end of the gauge section 24 of the bit. The bend 31 in FIG. 13 does not contact the wellbore as it does in FIG. 12. The third point of contact between the BHA and the wellbore in FIG. 13 is higher up on the BHA. The curvature of the wellbore is defined by these three points of contact between the BHA and the wellbore.

The curvature of the wellbore in FIG. 14 is the same as FIGS. 12 and 13. The RSD 110 in FIG. 14 utilizes a short bend 132 to bit face 22 length that is less than the limit of twelve times the bit diameter of the present invention. The bend to bit face length in FIG. 14 is less than FIG. 13. The total gauge length of the bit is longer than the required minimum length of 0.75 times the bit diameter of the present invention and at least 50% of the total gauge length is substantially full gauge. The bend angle in FIG. 14 between the central axis of the lower portion of the rotating shaft 124 and the central axis of the non-rotating housing 130 is less than the bend angle in FIG. 13. The first point of contact 238 between the BHA and the wellbore in FIG. 14 is at the bit face as it is in FIG. 13. The second point of contact between the BHA and the wellbore in FIG. 14 is at the upper end of the gauge section of the bit 200 as it is in FIG. 13. The third point of contact between the BHA and the wellbore in FIG. 14 is higher up on the BHA. The curvature of the wellbore is defined by these three points of contact between the BHA and the wellbore.

The significant reduction in WOB as measured at the surface while the motor is sliding to build is believed primarily to be attributable to the significant reduction in the forces used to overcome drag. The significant reduction in actual WOB allows for reduced bearing pack length, which in turn allows for a reduced spacing between the bend and the bit face. These factors thus allow the use of a smaller bend angle to achieve the same build rate, which in turn results in a much higher hole quality, both when sliding to form the curved section of the borehole and when subsequently rotating the motor housing to drill a straight line tangent section.

The concepts of the present invention thus result in unexpectedly higher ROP while the motor is sliding. The lower bend angle in the motor housing also contributes to high drilling rates when the motor housing is rotated to drill a straight tangent section of the deviated borehole. The hole quality is thus significantly improved when drilling both the curved section and the straight tangent section of the deviated borehole by minimizing or avoiding hole spiraling. A motor with a 1° bend according to the present invention may thus achieve a build comparable to the build obtained with a 2° bend using a prior art BHA. The bend in the motor housing according to this invention is preferably less than about 1.25°. By providing a bend less than 1.5° and preferably less than 1.25°, the motor can be rotated to drill a straight tangent section of the deviated borehole without inducing high stresses in the motor.

Reduced WOB may be obtained in large part because the motor is slick, thereby reducing drag. Because of the high quality of the hole and the reduced bend angle, drag is further reduced. The consistent actual WOB results in efficient bit cutting since the PDC cutters can efficiently cut with a reliable shearing action and with minimal excessive WOB. The BHA builds a deviated borehole with surprisingly consistent tool face control.

Since the actual WOB is significantly reduced, the torque requirements of the PDM are reduced. Torque-on-bit (TOB) is a function of the actual WOB and the depth of cut. When the actual WOB is reduced, the TOB may also be reduced, thereby reducing the likelihood of the motor stalling and reducing excessive motor wear. In some applications, this may allow a less aggressive and lower torque lobe configuration for the rotor/stator to be used. This in turn may allow the PDM to be used in high temperature drilling applications since the stator elastomer has better life in a low torque mode. The low torque lobe configuration also allows for the possibility of utilizing more durable metal rotor and stator components, which have longer life than elastomers, particularly under high temperature conditions. The relatively low torque output requirement of the PDM also allows for the use of a short length power section. According to the present invention, the axial spacing along the power section central axis between the uppermost end of the power section of the motor and the bend is less than 40 times the bit diameter, and in many applications is less than 30 times the bit diameter. This short motor power section both reduces the cost of the motor and makes the motor more compatible for traveling through a deviated borehole without causing excessive drag when rotating the motor or when sliding the motor through a curved section of the deviated borehole.

The reduced WOB, both actual and as measured at the surface, required to drill at a high ROP desirably allows for the use of a relatively short drill collar section above the motor. Since the required WOB is reduced, the length of the drill collar section of the BHA may be significantly reduced to less than about 200 feet, and frequently to less than about 160 feet. This short drill collar length saves both the cost of expensive drill collars, and also facilitates the BHA to easily pass through the deviated borehole during drilling while minimizing the stress on the threaded drill collar connections.

Rates of Penetration

When sliding the motor to build, ROP rates are generally considered significantly lower than the rates achieved when rotating the motor housing. Also, prior tests have shown that the combination of (1) a fairly sharp build obtained by sliding the motor with no rotation, (2) followed by a straight hole tangent achieved by rotating the motor housing, and then (3) another fairly sharp build as compared to a slow build trajectory along a continuous curve with the same end point, results in less overall torque and drag associated with sliding (allowing for increased ROP in this hole section), and further results in a hole section geometry thought to reduce the drag associated with this section and its impact on ROP in subsequent hole sections. A curve/straight/curve approach is believed by many North Sea operators to result in a hole section geometry resulting in less contact between the drill pipe connections and the borehole wall, a subtle effect not captured in modeling but nonetheless believed to reduce drag. Common practice has thus often been to plan on a curve/straight/curve, based upon experience with (I) faster ROP (less sliding), and also experience that (ii) subsequent operations reflect lesser drag in this upper section.

The present invention contradicts the above assumption by achieving a high ROP using a slick BHA assembly, with a substantial portion of the deviated borehole being obtained by a continuous curve sections obtained when steering rather than by a straight tangent section obtained when rotating the motor housing. According to the present invention, relatively long sections of the deviated borehole, typically at least 40 feet in length and often more than 50 feet in length, may be drilled with the motor being slid and not rotating, with a continuous curve trajectory achieved with a low angle bend in the motor. Thereafter, the motor housing may be rotated to drill the borehole in a straight line tangent to better remove cuttings from the hole. The motor rotation operation may then be terminated and motor sliding again continued. The system of the present invention results in improvements to the drilling process to the extent that, firstly, the sliding ROP is much closer to that of the prior art rotating ROP during the drilling of this section and, secondly, the possibly adverse geometry effects of the continuous curve are more than offset by the hole quality improvement, such that the continuous curve results in a net decreased drag impacting subsequent drilling operations.

It is a particular feature of the invention that in excess of 25% of the length of the deviated borehole may be obtained by sliding a non-rotating motor. This percentage is substantially higher than that taught by prior art techniques, and in many cases may be as high as 40% or 50% of the length of the deviated borehole, and may even be as much as 100%, without significant impairment to ROP and hole cleaning. The operator accordingly may plan the deviated borehole with a substantial length being along a continuous smooth curve rather than a sharp curve, a comparatively long straight tangent section, and then another sharp curve.

Referring to FIG. 3, the deviated borehole 60 according to the present invention is drilled from a conventional vertical borehole 62 utilizing the BHA simplistically shown in FIG. 3. The deviated borehole 60 consists of a plurality of tangent borehole sections 64A, 64B, 64C and 64D, with curved borehole sections 66A, 66B and 66C each spaced between two tangent borehole sections. Each curved borehole section 66 thus has a curved borehole axis formed when sliding the motor during a build mode, while each tangent section 64 has a straight line axis formed when rotating the motor housing. When forming curved sections of the deviated borehole, the motor housing may be slid along the borehole wall during the building operations. The overall trajectory of the deviated borehole 60 thus much more closely approximates a continuous curve trajectory than that commonly formed by conventional BHAs.

FIG. 3 also illustrates in dashed lines the trajectory 70 of a conventional deviated borehole, which may include an initial relatively short straight borehole section 74A, a relatively sharp curved borehole section 76A, a long tangent borehole section 74B with a straight axis, and finally a second relatively sharp curved borehole section 76B. Conventional deviated borehole drilling systems demand a short radius, e.g., 78A, 78B, because drilling in the sliding mode is slow and because hole cleaning in this mode is poor. However, a short radius causes undesirable tortuosity with attendant concerns in later operations. Moreover, a short radius for the curved section of a deviated borehole increases concern for adequate cuttings removal, which is typically a problem while the motor housing is not rotated while drilling. A short bend radius for the curved section of a deviated borehole is tolerated, but conventionally is not desired. According to the present invention, however, the curved sections of the deviated borehole may each have a radius, e.g., 68A, 68B and 68C, which is appreciably larger than the radius of the curved sections of a prior art deviated borehole, and the overall drilled length of these curved sections may be much longer than the curved sections in prior art deviated boreholes. As shown in FIG. 3, the operation of sliding the motor housing to form a curved section of the deviated borehole and then rotating the motor housing to form a straight tangent section of the borehole may each be performed multiple times, with a rotating motor operation performed between two motor sliding operations.

The desired drilling trajectory may be achieved according to the present invention with a very low bend angle in the motor housing because of the reduced spacing between the bend and the bit face, and because a long curved path rather than a sharp bend and a straight tangent section may be drilled. In many applications wherein the drilling operators may typically use a BHA with a bend of approximately 2.0 degrees or more, the concepts of the present invention may be applied and the trajectory drilled at a faster ROP along a continuous curve with BHA bend angle at 1.25 degrees or less, and preferably 0.75 degrees or less for many applications. This reduced bend angle increases the quality of the hole, and significantly reduces the stress on the motor.

The BHA of the present invention may also be used to drill a deviated borehole when the BHA is suspended in the well from coiled tubing rather than conventional threaded drill pipe. The BHA itself may be substantially as described herein, although since the tool face of the bend in the motor cannot be obtained by rotating the coiled tubing, an orientation tool 46 is provided immediately above the motor 12, as shown in FIG. 1. An orientation tool 46 is conventionally used when coiled tubing is used to suspend a drill motor in a well, and may be of the type disclosed in U.S. Pat. No. 5,215,151. The orientation tool thus serves the purpose of orienting the motor bend angle at its desired tool face to steer when the motor housing is slid to build the trajectory.

One of the particular difficulties with building a deviated borehole utilizing a BHA suspended from coiled tubing is that the BHA itself is more unstable than if the BHA is suspended from drill pipe. In part this is due to the fact that the coiled tubing does not supply a dampening action to the same degree as that provided by drill pipe. When a BHA is used to drill when suspended from the coiled tubing, the BHA commonly experiences very high vibrations, which adversely affects both the life of the drill motor and the life of the bit. One of the surprising aspects of the BHA according to the present invention is that vibration of the BHA is significantly lower than the vibration commonly experienced by prior art BHAs. This reduced vibration is believed to be attributable to the long gauge provided on the bit and the short length between the bend and the bit, which increases the stiffness of the lower bearing section. An unexpected advantage of the BHA according to the present invention is that vibration of the BHA is significantly reduced when drilling both the curved borehole section or the straight borehole section. Reduced vibration also significantly increases the useful life of the bit so that the BHA may drill a longer portion of the deviated borehole before being retrieved to the surface.

The surprising results discussed above are obtained with a BHA with a combination of a slick PDM, a short spacing between the bend and the bit face, and a long gauge bit. It is believed that the combination of the long gauge bit and the short bend to bit face is considered necessary to obtain the benefits of the present invention. In some applications, the motor housing may include stabilizers or pads for engagement with the borehole which project radially outward from the otherwise uniform diameter sidewall of the motor housing. The benefit of using stabilizer in the motor relates to the stabilization of the motor during rotary drilling. However, stabilizers in the BHA may decrease the build rate, and often increase drag in oriented drilling. Much of the advantage of the invention is obtained by providing a high quality deviated hole which also significantly reduces drag, and that benefit should still be obtained when the motor includes stabilizers or pads.

By shortening the entire length of the motor, the MWD package may be positioned closer to the bit. Sensors 25 and 27 (see FIG. 2) may be provided within the long gauge section of the drill bit to sense desired borehole or formation parameters. An RPM sensor, an inclinometer, and a gamma ray sensor are exemplary of the type of sensors which may be provided on the rotating bit. In other applications, sensors may be provided at the lowermost end of the motor housing below the bend. Since the entire motor is shortened, the sensors nevertheless will be relatively close to the MWD system 40. Signals from the sensors 25 and 27 may thus be transmitted in a wireless manner to the MWD system 40, which in turn may transmit wireless signals to the surface, preferably in real time. Near bit information is thus available to the drilling operator in real time to enhance drilling operations.

Further Discussion on the Downhole Physical Interactions

With increased knowledge of the mechanism (i.e. downhole physical interactions) responsible for improved hole quality, higher ROP, better directional control and reduced downhole vibration, combined with the strategic use of sensors which provide real-time measurements which can be fed back into the drilling process, even further improved results may be expected.

The basic mechanical configuration of the BHA according to the present invention alleviates a number of mechanical configuration characteristics now realized to be contributory towards non-constructive behaviors of the bit. "Non-constructive" as used herein means all bit actions that are outside of the ideal regarding the bit engagement with the rock, "ideal" being characterized by:

- single axis rotation, which axis in relation to the geometry of the lower BHA in the hole defines the curve direction and build-up rate;
- which axis is invariant over time (except as a result of steering changes commanded/initiated for course changes);
- with relatively constant contact force (i.e. WOB) engaging the bit face cutters into the formation at the bottom of the hole;
- with relatively constant rotational speed, constant both in an average sense (i.e. RPM), and in an instantaneous sense (i.e., minimal deviation from the average over the course of a single bit revolution); and
- with steady advancement of the bit in the direction of the curve direction at a rate of penetration purely a function of the rate of rock removal by the face cutters at the bottom of the hole, the removed rock being cleared from the bit face with sufficient rapidity so as to not be reground by the bit.

The BHA assembly of this invention provides for constructive behavior of the bit without the non-constructive behaviors via use of the extended gauge surface as a stiff pilot, providing for the single axis rotation of the bit face on the bottom of the hole. Other important configuration features, namely the relatively short bit face to bend distance and the lack of stabilizers (or strategic sizing and placement of stabilizer as discussed below), are designed with the goal of not creating undesired contact in the borehole conflicting with the piloting action of the bit.

Such ideal bit engagement with the rock is, intuitively to one skilled in the art, going to be the most drilling efficient. In other words, of the overall torque-times-rpm power available at the bit, only that power required to remove the rock in the direction of the curve is preferably consumed, and little additional energy is consumed in other bit behaviors.

Prior art drilling systems typically teach away from this ideal, with there being many sources and mechanisms for non-constructive behaviors at the bit:

- Mud motor (and rotary steerable tool) drive shafts are typically considerably more laterally limber than the bit body and collars in the BHA, since the drive shafts have a smaller diameter than the collar and bit body elements in order to accommodate bearings to support the relative rotation to the housing. Mud-lubricated-bearing mud motors additionally introduce non-linear behavior in this lateral direction; the marine bearings often employed are very compliant in the lateral direction as compared to the collar stiffness, and radial clearance is provided between the shaft and bearing for hydrodynamic lubrication and support. Even metal, carbide, or composite bearings used in place of the marine bearing include a designed radial clearance for hydrodynamic purposes. The lateral limberness makes the entire assembly (bit/shaft) more prone to lateral deflection as a result of lateral static or dynamic loads. The additional non-linearity present with mud lubricated motor bearings exacerbates this effect, as both far less support and non-constant support is available to counteract the lateral loading. This lateral limberness is a contributing factor in non-constructive behaviors by the bit.
- Short gauge "directional" bits coupled with such limber shafts result in a bit/shaft rotating system with little bearing support on either end. As a consequence, complex three dimensional dynamics may evolve quickly in response to any lateral loadings. Such dynamics may include precession about an arbitrary point along this bit/shaft assembly, i.e., a localized whirl effect, which would tend to create a spiraling action at the bit. This effect may result even without an identifiable lateral loading, since merely the imbalances associated with gravity load or the bend angle of the motor could cause an initiation to such dynamic non-constructive behaviors of a limber, unsupported, rotating system.
- The addition of a piggy-back gauge sub on top of the bit may mitigate the above effect to an extent, but this sub itself may also provide an imbalance, unless some deliberate steps are taken in the design and manufacture of the bit and gauge sub combination.

A long bit to bend distance results in an elbow dragging effect, and prior art BHA configurations are prone to substantial side cutting. A bent motor will not fit into a wellbore without deflecting (straightening—to reduce the bend) unless the bend to bit distance is short enough to prevent dragging of the motor. In the circumstance that it does drag, if the bit is able to sidecut, then the sidecutting action will allow the motor bend to "relax" and be restored to its initial setting. But the substantial sidecutting action is a major source of non-constructive behavior, which is evidenced by bits "gearing" or "spiraling" the sides of the borehole, thus reducing borehole quality. These undesirable actions are substantially minimized by using a long gauge bit. When the bend to bit face distance is short enough for the motor to sit in the wellbore without contact at the bend, a long gauge bit provides inherent benefits and a good directional response.

The impact of stabilizing even a short bearing pack motor is that, unless this is done with great care (and because stabilizer placement axially is restricted by the motor construction and conceivably no suitable position exists), the stabilizers will recreate the contact that the short bend to bit distance is designed to eliminate.

Overly aggressive bits and inconsistent WOB result in torque and RPM spiking at the bit. Prior art practices have trended toward increasingly aggressive bits, with cutters designed to take a deeper cut out of the formation at the bottom of the hole with each revolution. Taking a larger cut requires a higher torque PDM. The inconsistent weight transfer associated with the greater hole drag of prior art methods results in inconsistent downhole (actual) WOB. The increased torque requirement coupled with the inconsistent actual WOB, is believed to result in increased variation of torque created at the bit. This variable bit torque is often not able to be accommodated instantaneously by the PDM motor (this is compounded because the higher average torque requirement is often closer to the motor's stall limit), and as a result the PDM motor and bit instantaneous RPM will fluctuate considerably. This reduces instantaneous drilling efficiency and ROP, and is a source of non-constructive bit behaviors.

The above arguments relating to non-constructive bit behaviors with respect to PDC bits are generally also applicable to the roller cone bits. While the roller cone bit interaction with the bottom of the hole (and the means of rock removal in the direction being drilled) is somewhat different from that of a PDC, the non-constructive behaviors can be very similar. Roller cone bits typically have less of a gauge surface than PDC's. Roller cone bits also may introduce more of a bit bounce action since roller cone bits rely on greater WOB to drill than PDC. A roller cone bit, like a PDC bit, benefits from stiff and true piloting of the bit itself to minimize the non-constructive behaviors. The comments on bit face to bend length and on the placement of stabilizers are thus also generally applicable to roller cone bits.

A preferred implementation for roller cone bit may utilize an integral extended length gauge section, with box up to maintain the stiffness. Use of a standard roller cone (pin-up, short gauge) with a box-box piggy-back gauge sub might also be acceptable, providing that measures are taken to precisely control the radial stack-ups. However the preferred approach is to manufacture the entire bit as an integral assembly inclusive of the gauge surface.

The Need for Downhole Measurements of the Drilling Process

The basic apparatus and methods discussed herein (i.e. long gauge bit, short bit-face-to-bend distance, low WOB) generally mitigates against the above described non-constructive behaviors, and promotes the ideal engagement with the rock at the bottom of the hole, and the superior drilling process results (ROP, directional control, vibration, hole quality). A basic configuration parameter set (i.e. bit length and cutter configuration, bit-face-to-bend length, motor configuration/RPM, WOB) may be prescribed for a particular drilling situation via the use of a relatively simple model, and a database of like-situation experience. Every well is however unique, and the model and like-situation experiences may not be sufficient to fully optimize the drilling performance results.

Moreover, the desired goal-weighting of a particular drilling situation may not always be the same. In certain circumstances, optimization weighted towards one or more of ROP, directional control, vibration, or hole quality may be of greater importance, or a broad optimization may be preferred.

There are a number of additional downhole variables, independent of the initial set-up, which may be specific to a particular well or field, or may vary over the course of a bit run, that may impact and detract from optimal drilling process results. Such variables include: formation variables (e.g. mineral composition, density, porosity, faulting, stress state, pore pressure, etc); hole condition (degree of washout, spiraling, rugosity, scuffing, cuttings bed formation, etc); motor power section condition (i.e. volumetric efficiency); bit condition, and variation in the surface supplied torque and weight.

All the factors above, namely the uniqueness of individual wells, the potential weighting of specific goals relating to the drilling performance results, and the host of independently occurring conditions during the course of a particular well or field, may detract from what would be considered ideal bit behavior, as compared to model results.

The present invention provides the ability to actively respond to these factors, making changes between bit runs and during bit runs, to better optimize the drilling process towards the specific results desired. The key is "closing the loop", with downhole measurements that may be related to these specific drilling process results of interest, and having a method for changing the drilling process in response to these measurements towards improvement of the results of interest.

A number of downhole measurements may be taken which directly or indirectly relate to the drilling process. In determining which downhole measurements provide the most useful feedback for use in controlling the drilling process, it is instructive to first review the relationships of the specific results groupings that the invention as discussed herein improves upon (ROP, directional control, downhole vibration, and hole quality), to each other.

ROP—The rate of penetration improvements are attributed in the above discussion to improvements in hole quality, and resultant steadier transfer of weight to bit, particularly when sliding. Configuration, methods, and conditions tending toward the ideal bit behavior as described above provide the most efficient use of energy downhole, and therefore optimizing ROP. Measuring ROP at surface is direct and conventional.

Directional Control—The directional control improvements are also attributed to the improvements in hole quality, resultant steadier weight transfer, and therefore less lag and overshoot in the response at the bit to steering change commands. The configuration, methods, and conditions tending towards the ideal bit behavior as described above also promote the efficient response to steering change commands. Directional control may qualitatively measured by the directional driller in the steering process.

Hole Quality—Hole quality can be quantified by measurements of hole gauge, spiraling, cuttings bed, etc. Improved hole quality results are related to the invention's configuration and methods, as discussed above. The invention results in the reduction of the non-constructive bit behaviors, and therefore a reduction in the amount of rock removal from the "wrong" places. ROP and directional control improvement are at least partially a result of aggregate hole quality improvement, as noted above. Improvements in casing, cementing, logging, and other operations also are resultant from improved hole quality. Accordingly, hole quality may in fact be the most important results grouping, and therefore may be the most important set of variables to measure as feedback in the control process. Various MWD instruments may be used to provide direct feedback post-run and during-run on the hole quality, including MWD caliper and annular pressure-while-drilling (for equivalent circulating pressure, "ECP", indicative of cuttings bed formation).

Downhole Vibration—Minimizing downhole vibration is an end in itself for improved life of the downhole instruments and drill stem hardware (i.e. minimizing collar wear and connection fatigue). Maintaining a low level of downhole vibration will in many cases be a result of maintaining a better quality hole. A hole over gauge, full of ledges, and/or spiraled will intuitively allow greater freedom of movement of the bit and BHA, and/or provide a forcing function to the rotating bit/BHA, and therefore resultant greater vibration downhole. Downhole vibration may be indicative of poor hole quality, but it also may be indicative of non-constructive bit behavior, and incipient poor ROP, steering, and hole quality. Measuring downhole vibration therefore may be the singularly most efficient means of feedback into the control process for optimization of all the invention's desired results. Coincidentally, downhole vibration is also a relatively simple measurement to make.

Sensor for Downhole Measurement of the Drilling Process and Hole Quality

MWD sensors for hole quality—MWD sensors positioned within the drill string above the motor have been used to measure hole quality directly. Several of these sensors are described via the patent specifications WO 98/42948, U.S. Pat. No. 4,964,085, and GB 2328746A each hereby incorporated by reference. Such specific sensors include the ultrasonic caliper for measuring hole gauge, ovality, and other shape factors. Spiraling may at times also be inferred from the caliper log. Future implementations could include an MWD hole imager, which would provide higher resolution (recorded log) image of the borehole wall, with features like ledging and spiraling shown in detail. The annular pressure-while-drilling sensor has been used to measure the annular pressure (ECP, equivalent circulating pressure) from which the pressure drop of the annulus may be determined and monitored over time. Increased pressure due to a building obstruction to annular flow (i.e., often cuttings bed build-up) may be differentiated from the slowly building increased annular pressure drop with increased depth. Cuttings bed build-up is a hole condition malady that detracts from ROP, steering control, and ultimately limits subsequent operations (e.g. running of casing). The caliper data and/or pressure-while-drilling ("PWD") data may be dumped as a recorded log at surface between bit runs, and/or provided continuously or occasionally during the bit run via mud pulse to surface. These hole quality data may be then fed back to the drilling process, with resulting adjustments to the drilling process (e.g., hold back ROP, short trips, pill sweep, etc) for the purpose of improving upon the hole quality metrics being measured.

MWD sensors for vibration—MWD vibration sensors positioned within the drill string above the motor may be used to measure the downhole vibration directly, with inference of hole condition, and with inference of non-constructive bit behaviors and incipient hole condition degradation. Axial, torsional, and lateral vibration may be sensed. When the bit is drilling with ideal behavior as discussed above, there is very little vibration.

The onset of axial vibration is a direct indication of bit bounce, which may be inferred to be caused by the transients in weight transfer to the bits, such transients possibly a result of degrading hole condition (i.e. increased drag), with possible contribution from the drilling assembly itself being configured (i.e. bit gauge length, bit to bend distance, presence of and location of stabilizers) near the edge of the envelope for BHA ideal bit behavior for the particular set of conditions occurring in the hole.

the onset of torsional vibration is a direct indication of torsional slip/stick (i.e., torsional spiking of RPM) typically resultant from the bit or the string encountering greater torque resistance than can be smoothly overcome. This too can be indicative of degraded hole condition (torsional drag on string), whether caused by bit behaviors deviating from the ideal or caused independently. It too may be directly indicative of drilling practices (i.e., application of WOB and RPM) deviating from the ideal, or of changing conditions downhole (e.g., changing formation, degrading of bit or motor) such that a modification of drilling practices, or possibly of drilling assembly (e.g., new bit/motor or change aggressiveness of bit) may be required to get back to the ideal bit behavior, for the avoidance of the direct negative effects of the vibration and the resultant hole condition degradation.

The onset of lateral vibration is a direct indication of whirl of the bit/motor assembly, whether initiated at the bit or the BHA. It can also be indicative of degraded hole condition (lateral degree of freedom as a result of over gauge hole), whether caused by bit behaviors deviating from the ideal or caused independently (i.e., washout). It too can be directly indicative of drilling practices deviating from the ideal, or of a changing condition downhole such that modification of drilling practices or of drilling assembly may be required to return to the ideal bit behavior for the avoidance of the direct negative effects of such lateral vibration and for avoidance of the incipient hole quality degradation that results (e.g., enlarged and spiral hole due to whirl).

Bit Sensors for Vibration—Vibration sensors may also be packaged within the extended gauge section of the long gauge bit, where the greater proximity to the bit provides a more direct (i.e., less attenuated) measurement of the vibration environment. This closer proximity is especially useful in the BHA configuration discussed above, which when running properly (i.e., predominantly constructive bit behavior) has inherently a low level of vibration. By packaging such sensors in the bit, even subtle changes in vibration may be detected, and incipient hole quality degradation may be inferred.

Particular Sensor Embodiments

Packaging sensors in the bit presents certain challenges. The sensors associated with the more traditional MWD system are typically in one or more modules that are in sufficient proximity to each other so that power and communication linkages are not an issue. The power for all sensors may be supplied by a central battery assembly or turbine, and/or certain modules may have their own power supply (typically batteries). The MWD sensors whose data is required in real time are all typically linked by wires and connectors to the mud pulser (via a controller). One known implementation is to utilize a single conductor, plus the drill collars, as a ground path for both communications and power. Certain sensors integral with the MWD/FEWD (i.e. formation evaluation while drilling tool) are used to create a downhole time based log, which is not required in real time, and such a sensor may or may not have a direct communication link to the pulser. The downhole logs created from such sensors, as well as logs from the sensors for which selected data points are being pulsed to the surface, may be stored downhole either in a central memory unit or in distributed memory units associated with specific sensors. On tripping out of hole, a probe may then inserted into a side wall port in the MWD to dump this data at a fast rate from the MWD memory module(s) to the surface computer for further processing and/or presentation.

The simplest embodiment for the sensors in this invention may be to use a lateral vibration sensor, packaged above the PDM motor within the MWD system or in the bit, as experience shows the majority of non-constructive bit behaviors relating to degraded (or incipient degrading of) hole quality to have a significant lateral vibration indication. The simplest implementation is to provide for a data dump (i.e., time based log, with potential for depth correlation) at surface between runs, and to make configuration and/or practices adjustments on the basis of this data. An improvement is to provide for during-run pulsing to surface of this vibration data, for mid run improvements to practices.

Another sensor of value relating to the bit behavior is a bit RPM sensor (packaged either in the bit or in the motor or rotary steerable, utilizing magnetometers or accelerometers rotating with the bit or drive shaft, or other sensors detecting such rotation from the housing). This sensor may be used to detect steady changes in bit RPM, reflective possibly of lessening PDM volumetric efficiency, due to motor wear or to steady increase in torque consumed at the bit. Increased torque consumption, all other conditions being the same, is again a potential indicator of hole quality degrading. It may also be a direct indication of the onset of substantial side-cutting or other non-constructive behaviors at the bit that detract from ROP and steering control. The RPM sensor too would be able to detect instantaneous changes (i.e. spiking) of RPM over the course of a single bit revolution, as with the torsional vibration sensor, indicative of torsional slip/stick or whirling as discussed above. By the same logic, the RPM sensor may be used to monitor hole quality for feedback into the process of controlling/improving the hole quality results.

Other sensors (e.g. weight-on-bit "WOB", torque-on-bit "TOB") may be packaged substantially along the total gauge length of the long gauge bit, or at other locations along the drill string, for the purpose of detecting hole quality parameters, and/or non-constructive bit behaviors which would result in reduced drilling performance results including ROP, directional control, vibration, and hole quality. Such sensor data may be used between bit runs or during bit runs as feedback into the control process, with changes to the configuration or drilling process being made towards the improvement of the drilling process results.

When including sensors positioned substantially along the total gauge length of the long gauge bit, several techniques for achieving the power and communications requirements may be used. In the rotary steerable embodiment, one may run a wire with appropriate connectors from the MWD modules and pulser, through the rotary steerable tool, and into the extended gauge bit. In the PDM motor embodiment, this is much less practical because of the relative rotation between the MWD tool and the bit. A better implementation would include a distributed power source within the bit module (i.e. batteries). There should be sufficient room in the extended gauge bit module for the relatively small number of batteries required to power the sensors discussed above for use in the bit (as well as other sensors) if designed for low power usage.

Communications with the bit sensors may be achieved via use of an acoustic or electromagnetic telemetry short hop from the bit module up to the MWD (a distance typically between 30-60 ft). These short hop telemetry techniques are well known in the art. Experiments have demonstrated the feasibility of both techniques in this or similar applications. Via such linkages, data from the bit sensors can be conveyed to the MWD tool and pulsed to surface in real time for real time decisions relating to the hole quality results. Alternatively, or in conjunction, a memory module may be employed in the bit module. A time based downhole log maintained of the measurements may then be dumped after tripping out of the hole in a manner similar to the dumping of the data from the main MWD/FEWD sensors. The simple implementation does not require a data port in the side of the extended gauge bit; typically between bit runs the bit is removed from the PDM motor or rotary steerable tool, and this affords an opportunity to access the bit instrument module directly through the box connection. A probe nevertheless may still utilized with a side wall port, but the complications of maintaining the integrity of this port in exposure to the borehole conditions at the bit are eliminated by the previously disclosed alternative.

Figure 9:
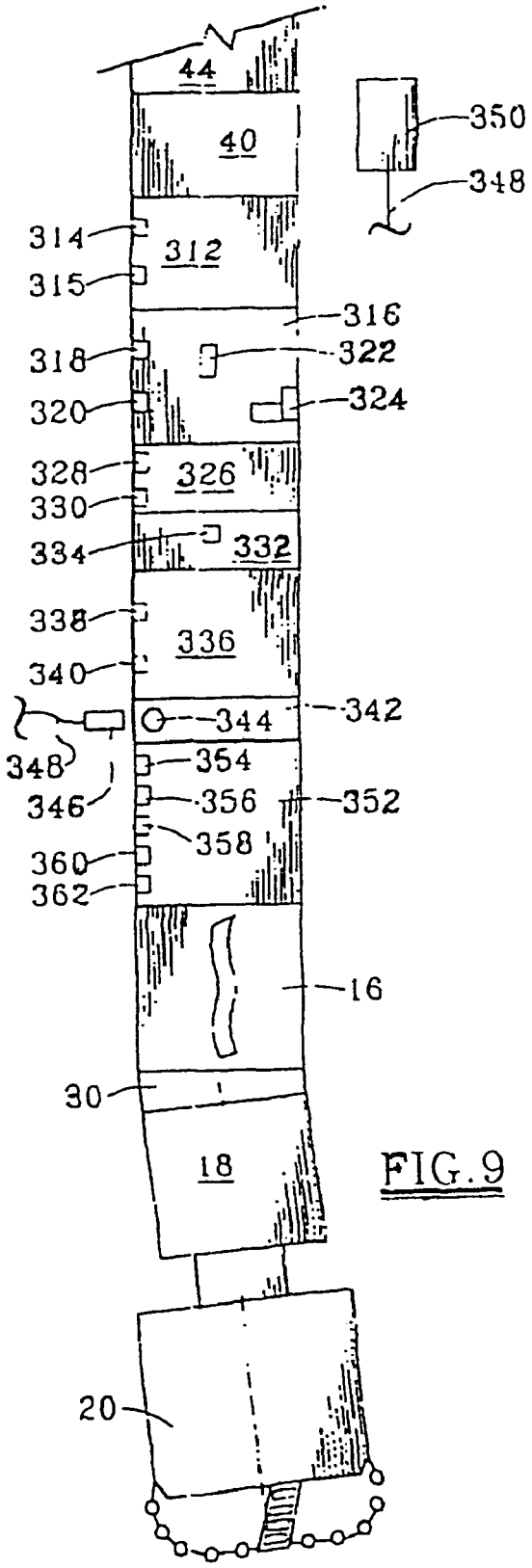
FIG. 9 depicts a steerable BHA according to the present invention with a slick mud motor (PDM) and a long gauge bit, illustrating particularly the position of various sensors in the BHA.

FIG. 9 illustrates a BHA according to the present invention. The drill string 44 conventionally may include a drill collar assembly (not depicted) and an MWD mud pulser or MWD system 40 as discussed above. The BHA as shown in FIG. 9 also includes a sensor sub 312 having one or more directional sensors 314, 315 which are conventionally used in an MWD system. FIG. 9 also illustrates the use of a sensor sub 316 for housing one or more pressure-while-drilling sensors 318, 320. One or more sensors 322 may be provided for sensing the fluid pressure in the interior of the BHA, while another sensor 324 is provided for sensing the pressure in the annulus surrounding the BHA. Yet another sensor sub 326 is provided with one or more WOB sensors 328 and/or one or more TOB sensors 330. Yet another sub 332 includes one or more tri-axial vibration sensors 334. The sub 336 may include one or more caliper sensors 338 and one or more hole image sensors 340. Sub 342 is a side wall readout (SWRO) sub with a port 344. Those skilled in the art will appreciate that the SWRO sub 342 may be interfaced with a probe 346 while at the surface to transmit data along hard wire line 348 to surface computer 350. Various SWRO subs are commercially available and may be used for dumping recorded data at the surface to permanent storage computers. Sub 352 includes one or more gamma sensors 354, one or more resistivity sensors 356, one or more neutron sensors 358, one or more density sensors 360, and one or more sonic sensors 362. These sensors are typical of the type of sensors desired for this application, and thus should be understood to be exemplary of the type of sensors which may be utilized according to the BHA of the present invention.

The sub 352 ideally is provided immediately above the power section 16 of the motor. FIG. 9 also illustrates a conventional bent housing 30 and a lower bearing housing 18 and a rotary bit 20. Those skilled in the art will appreciate that the subs 40, 312 and 342 are conventionally used in BHA's, and while shown for an exemplary embodiment, this discussion should not be understood as limiting the present invention. Also, those skilled in the art will appreciate that the positioning of the PWD sensor housing 314, the SWRO housing 342, and the housing 352 are exemplary, and again should not be understood as limiting. Furthermore, the power section 16 of the motor, the bent housing 30, and the bearing section 18 of the motor are optional locations for specific sensors according to the present invention, and particularly for an RPM sensor to sense the rotational speed of the shaft and thus the bit relative to the motor housing, as well as sensors to measure the fluid pressure below the power section of the motor.

Figure 10:
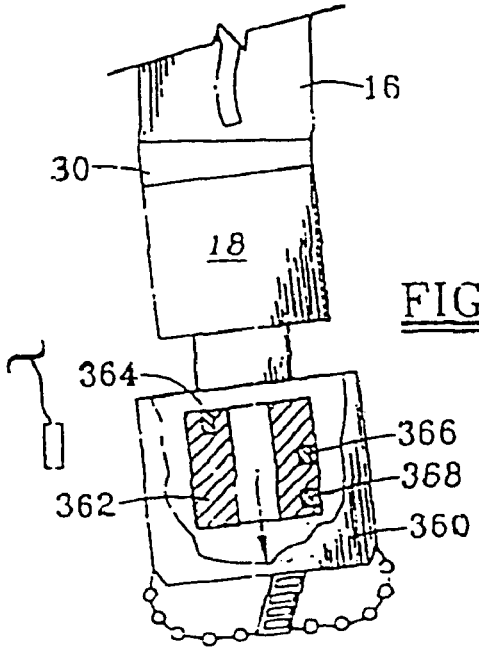
FIG. 10 is a schematic representation of a BHA according to the present invention, illustrating particularly an instrument insert package within a long gauge bit.

FIG. 10 is an alternate embodiment of a portion of the BHA shown in FIG. 9. Unless otherwise disclosed, it should be understood that the components above the power section 16 the BHA in FIG. 10 may conform to the same components previously discussed. In this case, however, the bit 360 has been modified to include an insert package 362, which preferably has a data port 364 as shown. The instrument package 362 is provided substantially within the total gauge length of the bit 360, and may include various of the sensors discussed above, and more particularly sensors which the operator uses to know relevant information while drilling from sensors located at or very closely adjacent the cutting face of the bit. In an exemplary application, the sensor package 362 would thus include at least one or more vibration sensors 366 and one or more RPM sensors 368.

Figure 11:
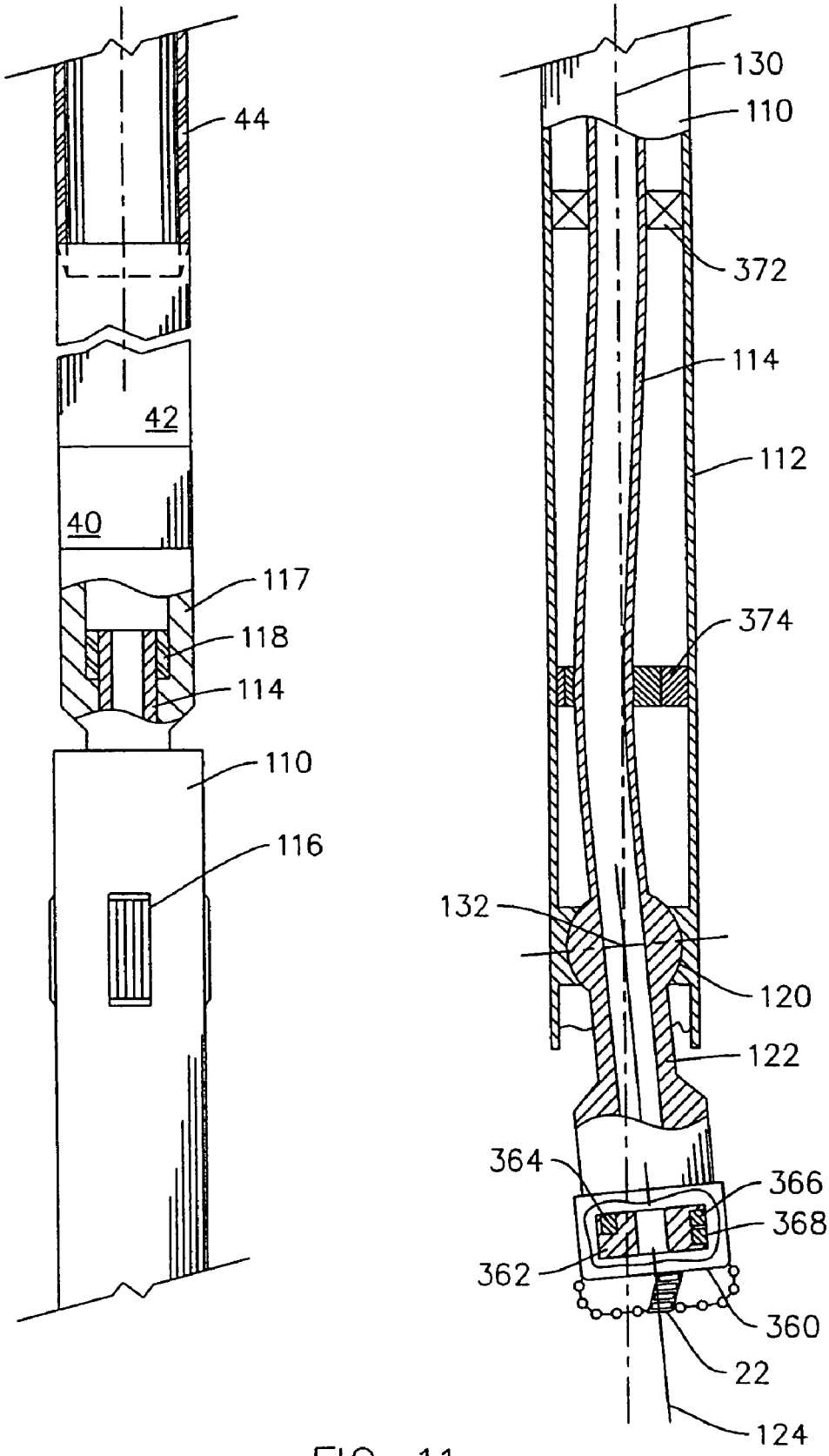
FIG. 11 depicts a BHA with a rotary steerable device (RSD) according to the present invention, with the bend angles and the spacing exaggerated for explanation purposes, also illustrating sensors in the long gauge bit.

Certain other sensors may be preferably used when placed in a sealed bearing roller cone bit. Sensors that measure the temperature, pressure, and/or conductivity of the lubricating oil in the roller cone bearing chamber may be used to make measurements indicative of seal or bearing failure either having occurred or being imminent FIG. 11 depicts yet another embodiment of a BHA according to the present invention. Again, FIG. 9 may be used to understand the components not shown above the housing 352. In this case, a driving source for rotating the bit is not a PDM motor, but instead a rotary steerable application is shown, with the rotary steerable housing 112 receiving the shaft 114 which is rotated by rotating the drill string at the surface. Various bearing members 120, 374, 372 are axially positioned along the shaft 114. Again, those skilled in the art should understand that the rotary steerable mechanism shown in FIG. 11 is highly simplified. The bit 360 may include various sensors 366, 368 which may be mounted on an insert package 362 provided with a data port 364 as discussed in FIGS. 9 and 10.

Rotary Steerable Applications

The concepts of the present invention may also be applied to rotary steerable applications. A rotary steerable device (RSD) is a device that tilts or applies an off-axis force to the bit in the desired direction in order to steer a directional well while the entire drillstring is rotating. Typically, an RSD will replace a PDM in the BHA and the drillstring will be rotated from surface to rotate the bit. There may be circumstances where a straight PDM may be placed above an RSD for several reasons: (I) to increase the rotary speed of the bit to be above the drillstring rotary speed for a higher ROP; (ii) to provide a source of closely spaced torque and power to the bit; (iii) and to provide bit rotation and torque while drilling with coiled tubing.

FIG. 11 depicts an application using a rotary steerable device (RSD) 110 in place of the PDM. The RSD has a short bend to bit face length and a long gauge bit. While steering, directional control with the RSD is similar to directional control with the PDM. The primary benefits of the present invention may thus be applied while steering with the RSD.

An RSD allows the entire drillstring to be rotated from surface to rotate the drill bit, even while steering a directional well. Thus an RSD allows the driller to maintain the desired toolface and bend angle, while maximizing drillstring RPM and increasing ROP. Since there is no sliding involved with the RSD, the traditional problems related to sliding, such as discontinuous weight transfer, differential sticking, hole cleaning, and drag problems, are greatly reduced. With this technology, the well bore has a smooth profile as the operator changes course. Local doglegs are minimized and the effects of tortuosity and other hole problems are significantly reduced. With this system, one optimizes the ability to complete the well while improving the ROP and prolonging bit life.

FIG. 11 depicts a BHA for drilling a deviated borehole in which the RSD 110 replaces the PDM 12. The RSD in FIG. 11 includes a continuous, hollow, rotating shaft 114 within a substantially non-rotating housing 112. Radial deflection of the rotating shaft within the housing by a double eccentric ring cam unit 374 causes the lower end of the shaft 122 to pivot about a spherical bearing system 120. The intersection of the central axis of the housing 130 and the central axis of the pivoted shaft below the spherical bearing system 124 defines the bend 132 for directional purposes. While steering, the bend 132 is maintained in a desired toolface and bend angle by the double eccentric cam unit 374. To drill straight, the double eccentric cams are arranged so that the deflection of the shaft is relieved and the central axis of the shaft below the spherical bearing system 124 is put in line with the central axis of the housing 130. As shown in FIG. 11, the rigid housing 112 manufactured from metal may experience nominal deflection in some downhole applications, but the housing 112 itself is rigid at least from the position of the upper shaft bearing 372 to the intersection of the central axis of the housing 130 with the central axis of the bent rotary shaft. i.e., the bend 132 shown in FIG. 11. The features of this RSD are described below in further detail.

The RSD 110 in FIG. 11 includes a substantially non-rotating housing 112 and a rotating shaft 114. Housing rotation is limited by an anti-rotation device 116 mounted on the non-rotating housing 112. The rotating shaft 114 is attached to the rotary bit 20 at the bottom of the RSD 110 and to drive sub 117 located near the upper end of the RSD through mounting devices 118. A spherical bearing assembly 120 mounts the rotating shaft 114 to the non-rotating housing 112 near the lower end of the RSD. The spherical bearing assembly 120 constrains the rotating shaft 114 to the non-rotating housing 112 in the axial and radial directions while allowing the rotating shaft 114 to pivot with respect to the non-rotating housing 112. Other bearings rotatably mount the shaft to the housing including bearings at the eccentric ring unit 374 and the cantilever bearing 372. From the cantilever bearing 372 and above, the rotating shaft 114 is held substantially concentric to the housing 112 by a plurality of bearings. Those skilled in the art will appreciate that the RSD is simplistically shown in FIG. 11, and that the actual RSD is much more complex than depicted in FIG. 11. Also, certain features, such as bend angle and short lengths, are exaggerated for illustrative purposes.

Bit rotation when implementing the RSD is most commonly accomplished without the use of a PDM power section 16. Rotation of the drill string 44 by the drilling rig at the surface causes rotation of the BHA above the RSD, which in turn directly rotates the rotating shaft 114 and rotary bit 20. Rotation of the entire drill string, even while steering, is a fundamental feature of the RSD as compared to the PDM.

While steering, directional control is achieved by radially deflecting the rotating shaft 114 in the desired direction and at the desired magnitude within the non-rotating housing 112 at a point above the spherical bearing assembly 120. In a preferred embodiment, shaft deflection is achieved by a double eccentric ring cam unit 374 such as disclosed in U.S. Pat. Nos. 5,307,884 and 5,307,885. The outer ring, or cam, of the double eccentric ring unit 374 has an eccentric hole in which the inner ring of the double eccentric ring unit is mounted. The inner ring has an eccentric hole in which the shaft 114 is mounted. A mechanism is provided by which the orientation of each eccentric ring can be independently controlled relative to the non-rotating housing 112. This mechanism is disclosed in U.S. application Ser. No. 09/253,599 filed Jul. 14, 1999 entitled "Steerable Rotary Drilling Device and Directional Drilling Method." By orienting one eccentric ring relative to the other in relation to the orientation of the non-rotating housing 112, deflection of the rotating shaft 114 is controlled as it passes through the eccentric ring unit 374. The deflection of the shaft 114 can be controlled in any direction and any magnitude within the limits of the eccentric ring unit 374. This shaft deflection above the spherical bearing system causes the lower portion of the rotating shaft 122 below the spherical bearing assembly 120 to pivot in the direction opposite the shaft deflection and in proportion to the magnitude of the shaft deflection. For the purposes of directional drilling, the bend 132 occurs within the spherical bearing assembly 120 at the intersection of the central axis 130 of the housing 112 and the central axis 124 of the lower portion of the rotating shaft 122 below the spherical bearing assembly 120. The bend angle is the angle between the two central axes 130 and 124. The pivoting of the lower portion of the rotating shaft 122 causes the bit 20 to tilt in the intended manner to drill a deviated borehole. Thus the bit toolface and bend angle controlled by the RSD are similar to the bit toolface and bend angle of the PDM. Those skilled in the art will recognize that use of a double eccentric ring cam is but one mechanism of deviating the bit with respect to a housing, for purposes of directional drilling with an RSD.

While steering, directional control with the RSD 110 is similar to directional control with the PDM 12. The central axis 124 of the lower portion of the rotating shaft 122 is offset from the central axis 130 of the non-rotating housing 112 by the selected bend angle. For purposes of analogy, the bearing package assembly 19 in the lower housing 18 of the PDM 12 is replaced by the spherical bearing assembly 120 in the RSD 110. The center of the spherical bearing assembly 120 is coincident with the bend 132 defined by the intersection of the two central axes 124 and 130 within the RSD 110. As a result, the bent housing 30 and lower bearing housing 18 of the PDM 12 are not necessary with the RSD 110. The placement of the spherical bearing assembly at the bend and the elimination of these housings results in a further reduction of the bend 132 to bit face 22 distance along the central axis 124 of the lower portion of the rotating shaft 122.

When it is desired to drill straight, the inner and outer eccentric rings of the eccentric ring unit 374 are arranged such that the deflection of the shaft above the spherical bearing assembly 120 is relieved and the central axis 124 of the lower portion of the rotating shaft 122 is coaxial with the central axis 130 of the non-rotating housing 112. Drilling straight with the RSD is an improvement over drilling straight with a PDM because there is no longer a bend that is being rotated. Housing stresses on the PDM will be absent and the borehole should be kept closer to gauge size.

As with the PDM, the axial spacing along the central axis 124 of the lower portion of the rotating shaft 122 between the bend 132 and the bit face 22 for the RSD application could be as much as twelve times the bit diameter to obtain the primary benefits of the present invention. In a preferred embodiment, the bend to bit face spacing is from four to eight times, and typically approximately five times, the bit diameter. This reduction of the bend to bit face distance means that the RSD can be run with less bend angle than the PDM to achieve the same build rate. The bend angle of the RSD is preferably less than 0.6 degrees and is typically about 0.4 degrees. The axial spacing along the central axis 130 of the non-rotating housing 112 between the uppermost end of the RSD 110 and the bend 132 is approximately 25 times the bit diameter. This spacing of the RSD is well within the comparable spacing from the uppermost end of the power section of the PDM to the bend of 40 times the bit diameter.

Because the RSD has a short bend to bit face length and is similar to the PDM in terms of directional control while steering, the primary benefits of the present invention are expected to apply while steering with the RSD when run with a long gauge bit having a total gauge length of at least 75% of the bit diameter and preferably at least 90% of the bit diameter and at least 50% of the total gauge length is substantially full gauge. These benefits include higher ROP, improved hole quality, lower WOB and TOB, improved hole cleaning, longer curved sections, fewer collars employed, predictable build rate, lower vibration, sensors closer to the bit, better logs, easier casing run, and lower cost of cementing.

Several of these benefits are enhanced by the ability to rotate the drill string while steering with the RSD. Rotation of the drill string while steering with the RSD, as opposed to sliding the drill string while steering with the PDM, reduces the axial friction which also improves ROP and the smooth transfer of weight to the bit. Rotation of the drill string reduces ledges in the borehole wall which helps weight transfer to the bit and improves hole quality and the ease of running casing. Rotation of the drill string also stirs up cuttings that would otherwise settle to the low side of the borehole while sliding, resulting in improved hole cleaning and better weight transfer to the bit.

Several of these benefits are also enhanced by the shorter bend to bit face length of the RSD compared to the PDM, which then means that a lower bend angle may be employed. When combined with the long gauge bit, these factors improve stability which is expected to improve borehole quality by reducing hole spiraling and bit whirling. Improved weight transfer to the bit is also expected. The shorter bend to bit face length of the RSD means that an acceptable build rate may be achieved even with a box connection at the lowermost end of the rotating shaft 114. A pin connection may be used at this location and some additional improvement to the build rate may be expected.

An additional enhancement is that the RSD may contain sensors mounted in the non-rotating housing 112 and a communication coupling to the MWD. The ability to acquire near bit information and communicate that information to the MWD is improved when compared with the PDM. As with the PDM, sensors may be provided on the rotating bit when run with the RSD.

The non-rotating housing 112 of the RSD may contain the anti-rotation device 116 which means the housing is not slick as with the PDM. The design of the anti-rotation device is such that it engages the formation to limit the rotation of the housing without significantly impeding the ability of the housing to slide axially along the borehole when the RSD is run with a long gauge bit. Therefore, the effect of the anti-rotation device on weight transfer to the bit is negligible.

With the exception of the anti-rotation device, the non-rotating housing 112 of the RSD is preferably run slick. However, there may be cases where a stabilizer may be utilized on the non-rotating housing near the bend 132. One reason for the use of a stabilizer is that the friction forces between the stabilizer and the borehole would help to limit the rotation of the non-rotating housing. The drag on the RSD will likely be increased due to this stabilizer, as with a stabilizer on the PDM. However, with the RSD the effect of this stabilizer on weight transfer to the bit should be more than offset by the decrease in drag due to rotation of the drill string while steering.

The RSD may also be suspended in the well from coiled tubing provided some additional modifications are made to the BHA. The orientation tool used to orient the bend angle of the PDM is no longer required because the RSD maintains directional control of the rotary bit. However, since coiled tubing is not conventionally rotated from surface, another source of rotation and torque would typically be required to rotate the bit. A straight PDM or electric motor may thus be placed in the BHA above the RSD as a source of rotation and torque for the bit.

Further Advantages

The steerable system of the present invention offers significantly improved drilling performance with a very high ROP achieved while a relatively low torque is output from the PDM. Moreover, the steering predictability of the BHA is surprisingly accurate, and the hole quality is significantly improved. These advantages result in a considerable time and money savings when drilling a deviated borehole, and allow the BHA to drill farther than a conventional steerable system. Efficient drilling results in less wear on the bit and, as previously noted, stress on the motor is reduced due to less WOB and a lower bend angle. The high hole quality results in higher quality formation evaluation logs. The high hole quality also saves considerable time and money during the subsequent step of inserting the casing into the deviated borehole, and less radial clearance between the borehole wall and the casing or liner results in the use of less cement when cementing the casing or liner in place. Moreover, the improved wellbore quality may even allow for the use of a reduced diameter drilled borehole to insert the same size casing which previously required a larger diameter drilled borehole. These benefits thus may result in significant savings in the overall cost of producing oil.

While only particular embodiments of the apparatus of the present invention and preferred techniques for practicing the method of the present invention have been shown and described herein, it should be apparent that various changes and modifications may be made thereto without departing from the broader aspects of the invention. Accordingly, the purpose of the following claims is to cover such changes and modifications that fall within the spirit and scope of the invention.

What is claimed is:

1. A method, comprising:

drilling a deviated borehole using a bottom hole assembly while rotating a drill string from the surface, the bottom hole assembly having a rotary shaft of a rotary steerable device rotatable within a rigid housing extending from an upper shaft bearing positioned within the rigid housing to an intersection of a central axis of the rigid housing and a central axis of a lower deflected portion of the rotary shaft, the lower portion of the rotary shaft being deflected in response to a deflection device;

coupling an anti-rotation device to the rigid housing of the rotary steerable device;

the deflection device deflecting the rotary shaft by a transverse force acting between the rotary shaft and the rigid housing;

using a bit coupled to the rotary shaft to drill the deviated borehole, the bit having a bit face, the bit face having a bit full cutting diameter; and using a gauge section above the bit face, such that an axial length between the bit full cutting diameter and a top of the gauge section is at least 75% of the bit full cutting diameter.

2. A method of claim 1, wherein deflecting the rotary shaft comprises temporarily bending the rotary shaft using the transverse force.

3. A method of claim 1, wherein using a bit coupled to the rotary shaft to drill the deviated borehole comprises drilling the deviated borehole with a bottom hole assembly including a stabilizer coupled to the bit.

4. The method of claim 3, further comprising:

supporting at least a portion of the gauge section on the stabilizer.

5. A method of claim 1, further comprising:

rotatably fixing a stabilizer to the bit, the stabilizer providing at least a portion of the gauge section.

6. A method of claim 1, further comprising:

rotating the bit at a speed of less that 350 rpm to form a curved section of the borehole.

7. A method of claim 1, wherein rotary shaft deflection is adjustable while drilling the well by applying the transverse force to the rotary shaft in a controllable direction.

8. A method of claim 1, wherein a portion of the axial length of the gauge section which is substantially gauge is at least 50% of the gauge section axial length.

9. A method of claim 1, wherein the axial length between the bit full cutting diameter and the top of the gauge section is at least 90% of the bit full cutting diameter.

10. A method of claim 1, wherein at least 50% of the length of an outer surface of the gauge section includes a first diameter and one or more additional diameters, the first diameter and the one or more additional diameters each being no larger than the bit full cutting diameter, and smaller than the bit full cutting diameter by less than about ¼".

11. The method of claim 1, wherein the top of the gauge section which is substantially the bit full cutting diameter is smaller than the bit full cutting diameter by less than about ¼".

12. A method of claim 1, wherein the housing has a substantially uniform diameter outer surface.

13. A method of claim 1, further comprising:

providing a positive displacement motor above the rotary steerable device; and using the positive displacement motor to increase the rotary speed of the bit above the rotary speed of the drill string.

14. A method of claim 1, further comprising:

providing a measurement while drilling (MWD) system including one or more sensors on the rotary steerable device to sense one or more of borehole or formation parameters;

producing a log representing one or more of the borehole or formation parameters.

15. A method of claim 1, wherein the housing has a substantially uniform diameter outer surface.

16. A method of claim 1, wherein the rotary steerable device rotates the bit while maintaining less than 200 pounds of axial force per square inch on the bit face.

17. A method of directionally drilling a borehole with a drill string, the method comprising:

using the drill string to rotate a rotary shaft of a rotary steerable tool, the rotary shaft at least partially disposed in a rigid housing of the rotary steerable tool and coupled to the housing with one or more bearings, the rigid housing having coupled thereto an anti-rotation device to limit the rotation of the housing, the rigid housing having a housing central axis, at least a portion of the shaft capable of rotating about the upper axis while guided by an upper bearing acting between the rigid housing and the rotary shaft, and at least a portion of the shaft capable of being deflected from rotation about the upper axis by a transverse force applied between the rigid housing and the shaft below the upper bearing for rotation about a second rotational axis;

using a bit below the rotary steerable tool, the bit having a bit face, the bit face having a bit full cutting diameter, and using a gauge section above the bit face, such that the distance from the bit face to a top of the gauge section which is substantially the bit full cutting diameter is at least 75% of the bit full cutting diameter and the top of the gauge section is smaller than the bit full cutting diameter by less than about ¼"; and deflecting the rotary shaft while drilling the well by applying the transverse force to the rotary shaft in a controllable direction.

18. A method of claim 17, wherein the transverse force is applied in a controllable magnitude.

19. A method of claim 17, wherein the rotary shaft deflection directs the bit to a controllable toolface related to the controllable direction.

20. A method of claim 17, wherein the gauge section comprises a stabilizer coupled to the bit.

21. A method of claim 17, wherein at least 50% of the length of an outer surface of the gauge section includes a first diameter and one or more additional diameters, the first diameter and the one or more additional diameters each being no larger than the bit full cutting diameter, and smaller than the bit full cutting diameter by less than about ¼".

22. A method of claim 17, further comprising:

rotating the bit at a speed of less that 350 rpm to form a curved section of the borehole.

23. A method of claim 17, wherein the axial length between the bit full cutting diameter and the top of the gauge section is at least 90% of the bit full cutting diameter.

24. A method of claim 17, wherein using a gauge section above the bit face comprises drilling the borehole with a bottom hole assembly including a stabilizer coupled to the bit.

25. The method of claim 24, further comprising:

supporting at least a portion of the gauge section on the stabilizer.

26. A method of claim 17, further comprising:

providing a positive displacement motor above the rotary steerable tool; and using the positive displacement motor to increase the rotary speed of the bit above the rotary speed of the drill string.

27. A method of claim 17, further comprising:

providing a measurement while drilling (MWD) system including one or more sensors on the rotary steerable device to sense one or more of borehole or formation parameters;

producing a log representing one or more of the borehole or formation parameters.

28. A method of claim 17, wherein the housing has a substantially uniform diameter outer surface.

29. A method of claim 17, wherein the rotary steerable device rotates the bit white maintaining less than 200 pounds of axial force per square inch on the bit face.

30. A method of claim 21, wherein the rotary steerable device rotates the bit while maintaining less than 200 pounds of axial force per square inch on the bit face.

31. A method for directionally drilling a deviated borehole using a bottom hole assembly while rotating a drill string from the surface, the bottom hole assembly comprising:

a bit having a bit face, the bit face having a bit full cutting diameter;

a gauge section above the bit, the gauge section having a top end;

a rotary shaft above the gauge section;

a housing for a rotary steerable device, the housing having a longitudinal axis, the housing extending from an upper shaft bearing within the housing to a lower end of the housing;

the rotary shaft extending from the housing, a lower portion of the shaft having a lower central axis offset from the longitudinal axis when drilling a deviated borehole by a transverse force applied to the rotary shaft by a deflection device, an axial spacing between the bit face and an intersection of the longitudinal axis and the lower central axis being less than 12 times the bit diameter;

wherein the method comprises:

drilling with the bit, wherein an axial length from the bit full cutting diameter to the top end of the gauge section is at least 75% of the bit full cutting diameter.

32. A method of claim 31, further comprising:

rotating the bit at a speed of less than 350 rpm to form a curved section of the borehole.

33. A method of claim 31, wherein the gauge section comprises a stabilizer coupled to the bit.

34. A method of claim 31, wherein a stabilizer rotatably fixed to the bit provides at least a portion of the gauge section.

35. A method of claim 31, wherein at least 50% of the length of an outer surface of the gauge section includes a first diameter and one or more additional diameters, the first diameter and the one or more additional diameters each being no larger than the bit full cutting diameter, and smaller than the bit full cutting diameter by less than about ¼".

36. A method of claim 31, wherein the top of the gauge section which is substantially the bit full cutting diameter is smaller than the bit full cutting diameter by less than about ¼".

37. A method of claim 31, wherein the housing has a substantially uniform diameter outer surface.

38. A method of claim 31, wherein the axial length between the bit full cutting diameter and the top of the gauge section is at least 90% of the bit full cutting diameter.

39. A method of claim 31, wherein drilling with the bit comprises drilling the deviated borehole with a bottom hole assembly including a stabilizer coupled to the bit.

40. The method of claim 39, further comprising:

supporting at least a portion of the gauge section on the stabilizer.

41. A method of claim 31, further comprising:

providing a positive displacement motor above the rotary steerable device; and using the positive displacement motor to increase the rotary speed of the bit above the rotary speed of the drill string.

42. A method of claim 31, further comprising:

providing a measurement while drilling (MWD) system including one or more sensors on the rotary steerable device to sense one or more of borehole or formation parameters;

producing a log representing one or more of the borehole or formation parameters.

43. A method of claim 31, wherein the axial spacing between the bit face and the transverse force is less than 8 times the bit diameter.

44. A method of using a drill string and a bit having a bit face and a bit full cutting diameter to drill a borehole, comprising:

providing a stabilizer above the bit, the stabilizer having a gauge section, a portion of which is substantially the bit full cutting diameter, and wherein an axial length between the bit full cutting diameter and a top of the stabilizer gauge portion is at least 75% of the bit full cutting diameter;

providing a rotary steerable device with a shaft rotatable within a housing having a central axis;

using an anti-rotation device coupled to the housing to engage the borehole wall;

using a deflection device to apply a transverse force to the shaft, an axial spacing between the bit face and an intersection of the housing central axis and a lower central axis of a lower portion of the shaft offset from the housing central axis being less than 12 times the bit diameter; and using the rotary steerable device to directionally steer the bit while rotating the drill string.

45. A method of claim 44, wherein the stabilizer gauge section portion which is substantially the bit full cutting diameter is smaller than the bit full cutting diameter by less than about ¼".

46. A method of claim 44, further comprising:

coupling the stabilizer to rotate with the bit.

47. A method of claim 44, wherein the rotary steerable device includes a housing and the shaft is rotatable within at least a portion of the housing.

48. A method of claim 47, wherein the rotary steerable device includes a mechanism for deflecting a portion of the shaft within the housing, and the method further comprises deflecting the shaft to steer the bit.

49. A method of claim 48, wherein the deflection of the shaft is in a controlled direction and steers the bit in the direction opposite the controlled direction.

50. A method of claim 44, further comprising:

providing a positive displacement motor above the rotary steerable device; and using the positive displacement motor to increase the rotary speed of the bit above the rotary speed of the drill string.

51. A method of claim 44, further comprising:

using the rotary steerable device to steer the bit to drill a curve in a portion of the borehole and to drill straight in another portion of the borehole.

52. A method of claim 44, wherein the axial length between the bit full cutting diameter and the top of the gauge section is at least 90% of the bit full cutting diameter.

53. A method of claim 44, wherein the housing has a substantially uniform diameter outer surface.

54. A method of claim 44, further comprising:

rotating the bit at a speed of less that 350 rpm to form a curved section of the borehole.

55. A method of claim 44, further comprising:

providing a measurement while drilling (MWD) system including one or more sensors on the rotary steerable device to sense one or more of borehole or formation parameters;

producing a log representing one or more of the borehole or formation parameters.

56. A method of claim 44, wherein the axial spacing between the bit face and the transverse force is less than 8 times the bit diameter.

57. A method of claim 44, wherein the rotary steerable device rotates the bit while maintaining less than 200 pounds of axial force per square inch on the bit face.

58. A method to use a drill string and a bit having a bit face and a bit full cutting diameter to drill a borehole, comprising:

providing a stabilizer coupled above the bit, the stabilizer having a gauge section, a portion of which is substantially the bit full cutting diameter, and wherein an axial length between the bit full cutting diameter and a top of the stabilizer gauge portion is at least 75% of the bit full cutting diameter;

providing above the bit a rotary steerable device comprising a shaft and a rigid housing having a central axis, at least a portion of the shaft to rotate within the rigid housing, the rotary steerable device including a deflection device acting between the rigid housing and the shaft to deflect a lower portion of the shaft, the deflected portion of the shaft having a deflected central axis, the housing being rigid from an upper shaft bearing within the rigid housing to an intersection of the housing central axis and the shaft deflected central axis, and the shaft rotated from above the rotary steerable device; and using the rotary steerable device to directionally steer the bit while the shaft is rotated from above the rotary steerable device to drill the borehole.

59. A method of claim 58, wherein the shaft is rotated by coupling the shaft to a rotatable drill string.

60. A method of claim 58, wherein the shaft is rotated by a positive displacement motor above the shaft.

61. A method of claim 58, wherein the axial length between the bit full cutting diameter and the top of the gauge section is at least 90% of the bit full cutting diameter.

62. A method of claim 58, wherein the housing has a substantially uniform diameter outer surface.

63. A method of claim 58, further comprising:

rotating the bit at a speed of less that 350 rpm to form a curved section of the borehole.

64. A method of claim 58, wherein the stabilizer gauge section portion which is substantially the bit full cutting diameter is smaller than the bit full cutting diameter by less than about ¼".

65. A method of claim 58, further comprising:

providing a measurement while drilling (MWD) system including one or more sensors on the rotary steerable device to sense one or more of borehole or formation parameters;

producing a log representing one or more of the borehole or formation parameters.

66. A method of claim 58, wherein the rotary steerable device rotates the bit while maintaining less than 200 pounds of weight force per square inch of surface.

67. A method to drill a borehole and produce formation evaluation logs, comprising:

directionally drilling a deviated borehole using a bottom hole assembly (BHA) comprising (a) a bit having a bit face and a bit full cutting diameter; (b) a gauge section having a top, the gauge section spaced above the bit face, wherein an axial spacing between the bit face and the top of the gauge section which is substantially the bit full cutting diameter is at least 75% of the bit full cutting diameter; and (c) a rotary steerable device above the gauge section to steer the bit while the drill string rotates, the rotary steerable device including a rigid housing extending from an upper shaft bearing within the rigid housing to a deflection device within the rigid housing, the rigid housing having a central axis, the deflection device applying a transverse force to deflect the shaft, a lower portion of the shaft having a shaft central axis offset from the housing central axis, and an axial spacing between the bit face and an intersection of the housing central axis and the shaft central axis being less than 12 times the bit full cutting diameter;

providing a measurement while drilling (MWD) system within the BHA including one or more sensors to sense one or more of borehole or formation parameters;

producing a log representing one or more of the borehole or formation parameters.

68. A method of claim 67, wherein the rotary steerable device supports one or more sensors.

69. A method of claim 68, wherein the one or more sensors includes one or more of an RPM sensor, an inclinometer, or a vibration sensor.

70. A method of claim 67, further comprising:

adjusting drilling in response to at least one of the sensed borehole or formation parameters.

71. A method of claim 70, wherein the adjusting comprises adjusting one or more of weight on bit and rotary RPM.

72. A method of claim 67, further comprising:

transmitting signals to surface relating to one or more of the borehole or formation parameters.

73. A method of claim 67, further comprising:

providing a positive displacement motor above the rotary steerable device; and using the positive displacement motor to increase the rotary speed of the bit.

* * * * *

UNITED STATES PATENT AND TRADEMARK OFFICE

CERTIFICATE OF CORRECTION

PATENT NO. : 7,621,343 B2
APPLICATION NO. : 11/491738
DATED : November 24, 2009
INVENTOR(S) : Chen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 148 days.

Signed and Sealed this
Tenth Day of May, 2011

David J. Kappos

David J. Kappos
*Director of the United States Patent and Trademark Office*